US008646704B2

(12) United States Patent
Yamamoto et al.

(10) Patent No.: US 8,646,704 B2
(45) Date of Patent: Feb. 11, 2014

(54) INJECTOR

(75) Inventors: Kazuo Yamamoto, Nagoya (JP); Jun Yamashita, Kariya (JP)

(73) Assignee: Denso Corporation, Kariya (JP)

( * ) Notice: Subject to any disclaimer, the term of this patent is extended or adjusted under 35 U.S.C. 154(b) by 733 days.

(21) Appl. No.: 12/717,348

(22) Filed: Mar. 4, 2010

(65) Prior Publication Data

US 2011/0057059 A1 Mar. 10, 2011

(30) Foreign Application Priority Data

Mar. 5, 2009 (JP) ..... 2009-52458
Nov. 26, 2009 (JP) ..... 2009-269063

(51) Int. Cl.
*B05B 1/30* (2006.01)

(52) U.S. Cl.
USPC ..... 239/585.5; 239/533.9

(58) Field of Classification Search
USPC ..... 239/585.3, 585.4, 533.2, 586, 581.1, 239/585.5, 533.9, 533.12; 251/129.21
See application file for complete search history.

(56) References Cited

U.S. PATENT DOCUMENTS 4,905,962 A * 3/1990 Iljin ..... 251/129.16
5,033,716 A * 7/1991 Mesenich ..... 251/129.21
6,367,769 B1 4/2002 Reiter
6,520,434 B1 2/2003 Reiter
7,032,846 B1 * 4/2006 Heyse ..... 239/533.2
7,070,128 B2 * 7/2006 Delas ..... 239/585.5
7,789,322 B2 * 9/2010 Yamamoto et al. ..... 239/88
2003/0047626 A1 * 3/2003 Maier et al. ..... 239/585.5
2003/0102386 A1 6/2003 Sebastian et al.
2006/0226252 A1 10/2006 Kubo et al.
2007/0235669 A1 10/2007 Suzuki et al.

FOREIGN PATENT DOCUMENTS

JP 2007-224829 9/2007

OTHER PUBLICATIONS

Japanese Office Action dated Feb. 22, 2011 for corresponding Japanese Application No. 2009-269063 with English Translation.

* cited by examiner

*Primary Examiner* — Davis Hwu
(74) *Attorney, Agent, or Firm* — Nixon & Vanderhye PC

(57) ABSTRACT

An injector includes a housing, a fixed core, a movable core, a valve member, and a resilient member pressing the valve member toward a nozzle hole. An inner peripheral surface of the housing axially guides an outer peripheral surface of the movable core. The inner peripheral surface and the outer peripheral surface define an outer clearance therebetween. The valve member includes a shaft-shaped portion and a stopper portion, which contacts the movable core and has a stopper inclined surface. An outer peripheral surface of the shaft-shaped portion and an inner peripheral surface of an insertion hole of the movable core define an inner clearance therebetween. The stopper inclined surface inclines radially inward of the shaft-shaped portion axially toward the nozzle hole. An axial clearance is formed between the stopper inclined surface and the movable core radially outward of a contact portion between the stopper inclined surface and the movable core.

19 Claims, 10 Drawing Sheets

INJECTOR

CROSS REFERENCE TO RELATED APPLICATION

This application is based on and incorporates herein by reference Japanese Patent Application No. 2009-52458 filed on Mar. 5, 2009 and Japanese Patent Application No. 2009-269063 filed on Nov. 26, 2009.

BACKGROUND OF THE INVENTION

1. Field of the Invention

The present invention relates to, for example, an injector that injects and supplies fuel into an internal combustion engine.

2. Description of Related Art

As a conventional technology, an injector is described in a publication of JP-A-2007-278218 (corresponding to U.S. 2007/0235669A1). This injector includes a moving core and a needle serving as a valve member, and the moving core and the needle are provided independently of each other. The moving core slides in an axial direction of a housing relative to a fixed core. The needle slides in the axial direction of the housing in synchronization with the moving core so as to open and close an injection hole of the housing.

The moving core has a through hole portion in its central region. The through hole portion includes a large diameter portion on the fixed core-side and a small diameter portion on the injection hole-side. A step portion is formed between the large diameter portion and the small diameter portion. The needle includes a flanged head portion and a shaft portion extending from the head portion to the injection hole. An inner diameter of the small diameter portion of the moving core is larger than an outer diameter of the shaft portion of the needle. The shaft portion of the needle movably passes through the small diameter portion of the moving core, and the head portion of the needle is in contact with the step portion.

The head portion of the needle is urged toward the injection hole by a needle spring, and the moving core is urged toward the fixed core by a moving core spring.

In the above-described injector, upon energization of a coil of the fixed core, the moving core is magnetically attracted so as to move toward the fixed core. Furthermore, the needle also moves toward the fixed core together with the moving core, so that the injection hole is opened. When the moving core collides with the fixed core, the moving core rebounds to the opposite side of the fixed core. Nevertheless, because the needle is formed separately from the moving core, the needle moves toward the fixed core due to inertia force. Accordingly, despite the rebound of the moving core, an influence on the injection of fuel through the injection hole by the needle is reduced, and thereby the injection quantity of fuel is controlled with a high degree of accuracy.

In the above injector as the conventional technology, even if an axial center of the shaft portion of the needle is inclined relative to an axial center of the small diameter portion of the moving core due to, for example, part precision of the moving core and the needle, or variation in attachment therebetween, the whole surface contact between the fixed core and the moving core is achieved and sealing nature of the injection hole with the needle is ensured by setting a clearance between the small diameter portion and the shaft portion in a predetermined range.

However, as illustrated in FIG. 15A, a moving core 1 (step portion) and a head portion 2*a* of a needle 2 are brought into contact between their respective planar sections. For that reason, when the needle 2 inclines relative to the moving core 1 as illustrated in FIG. 15B, the moving core 1 and the head portion 2*a* of the needle 2 are in one-sided contact, so that wear is caused between the moving core 1 and the needle 2 due to the repetition of their sliding movement when opening and closing the injection hole. As a result, a position of the moving core 1 changes, and accordingly reliability is decreased.

Moreover, as illustrated in FIG. 16, when the moving core 1 is also inclined in accordance with the inclination of the needle 2, the moving core 1 and a fixed core 3 are in one-sided contact, so that wear is caused therebetween. Accordingly, a contact area between the moving core 1 and the fixed core 3 changes, and thereby reliability is decreased. In addition, because of wear caused between the inclined moving core 1 and a housing 5 as well, the position of the moving core 1 changes, and thus reliability is decreased. In a state where the moving core 1 is inclined in accordance with the inclination of the needle 2, due to force of a resilient member 4 that presses the needle 2 toward the injection hole, the moving core 1 comes into contact with the head portion 2*a* of the needle 2 between their planar sections, and the moving core 1 is pressed against an inner circumferential surface of the housing 5. For this reason, as illustrated in FIG. 17, a torque Fr (indicated by arrow with an alternate long and two short dashes line) is generated in a direction to return the moving core 1 to an uninclined normal position. However, since the moving core 1 and the head portion 2*a* are in contact between their planar sections without a clearance, the moving core 1 cannot rotate in a direction of the torque Fr. As a result, the moving core 1 cannot return back to the normal position, so that the moving core 1 is brought into one-sided contact with the fixed core 3 on the magnetically attracting side when opening the injection hole.

SUMMARY OF THE INVENTION

The present invention addresses at least one of the above disadvantages.

According to the present invention, there is provided an injector including a cylindrical housing, a fixed core, a cylindrical movable core, a valve member, and a resilient member. The housing includes a nozzle hole on one end side of the housing in an axial direction of the housing. Fuel is injected through the nozzle hole. The fixed core is fixed in the housing. The movable core is disposed in the housing between the fixed core and the nozzle hole in the axial direction to reciprocate in the housing in the axial direction. An inner peripheral surface of the housing guides an outer peripheral surface of the movable core in the axial direction. The inner peripheral surface of the housing and the outer peripheral surface of the movable core define an outer radial clearance therebetween. When fuel is injected, the movable core is magnetically attracted to the fixed core to be contactable with the fixed core along a whole circumference of the movable core. The movable core includes an insertion hole which passes through a radially central part of the movable core in the axial direction. The valve member is disposed in the housing to reciprocate in the axial direction, so that the valve member opens and closes the nozzle hole to inject fuel and stop injecting fuel through the nozzle hole. The valve member includes a shaft-shaped portion and a stopper portion. The shaft-shaped portion extends in the axial direction and inserted in the insertion hole. An outer peripheral surface of the shaft-shaped portion and an inner peripheral surface of the insertion hole define an inner radial clearance therebetween. The stopper portion projects from the shaft-shaped portion on a fixed core-side of the movable core in a flanged manner radially outward of the shaft-shaped portion to be contactable with the movable core, and includes a stopper inclined surface around an axis of the shaft-shaped portion. The stopper inclined surface is inclined radially inward of the shaft-shaped portion in the axial direction toward the nozzle hole so that the stopper inclined surface is contactable with the movable core at a contact portion. An axial clearance is formed between the stopper inclined surface and the movable core radially outward of the contact portion. The resilient member is disposed in the housing to press the valve member toward the nozzle hole.

According to the present invention, there is also provided an injector including a cylindrical housing, a fixed core, a coil, a cylindrical movable core, a valve member, and a resilient member. The housing includes a nozzle hole on one end side of the housing in an axial direction of the housing. Fuel is injected through the nozzle hole. The fixed core is fixed in the housing at a predetermined position thereof. The coil is energized. The movable core is disposed in the housing between the fixed core and the nozzle hole in the axial direction, and magnetically attracted to the fixed core upon energization of the coil. The valve member is disposed in the housing to reciprocate in the axial direction, so that the valve member opens and closes the nozzle hole to inject fuel and stop injecting fuel through the nozzle hole. The valve member includes a shaft-shaped portion and a stopper portion. The shaft-shaped portion is inserted in a central hole of the movable core which passes through a radially central part of the movable core in the axial direction, and extends toward the nozzle hole. The stopper portion is formed at a fixed core-side end portion of the shaft-shaped portion, and projects in a flanged manner radially outward of the shaft-shaped portion so as to be contactable with a surface of the movable core on the fixed core-side. The stopper portion includes a stopper inclined surface on a movable core-side of the stopper portion around an axis of the shaft-shaped portion. The stopper inclined surface is inclined relative to the axis. The movable core includes a movable core inclined surface on a stopper portion-side of the movable core. The movable core inclined surface is inclined along the stopper inclined surface. At least one of the stopper inclined surface and the movable core inclined surface is a curved surface that projects toward the other one of the stopper inclined surface and the movable core inclined surface. The resilient member is disposed in the housing to press the valve member toward the nozzle hole.

BRIEF DESCRIPTION OF THE DRAWINGS

The invention, together with additional objectives, features and advantages thereof, will be best understood from the following description, the appended claims and the accompanying drawings in which:

DETAILED DESCRIPTION OF THE INVENTION

Embodiments of the invention will be described below with reference to the accompanying drawings. By using the same numerals to indicate corresponding components in the embodiments, their repeated explanations are omitted.

(First Embodiment)

A first embodiment of the invention will be described below with reference to FIGS. 1 to 3.

Figure 1:
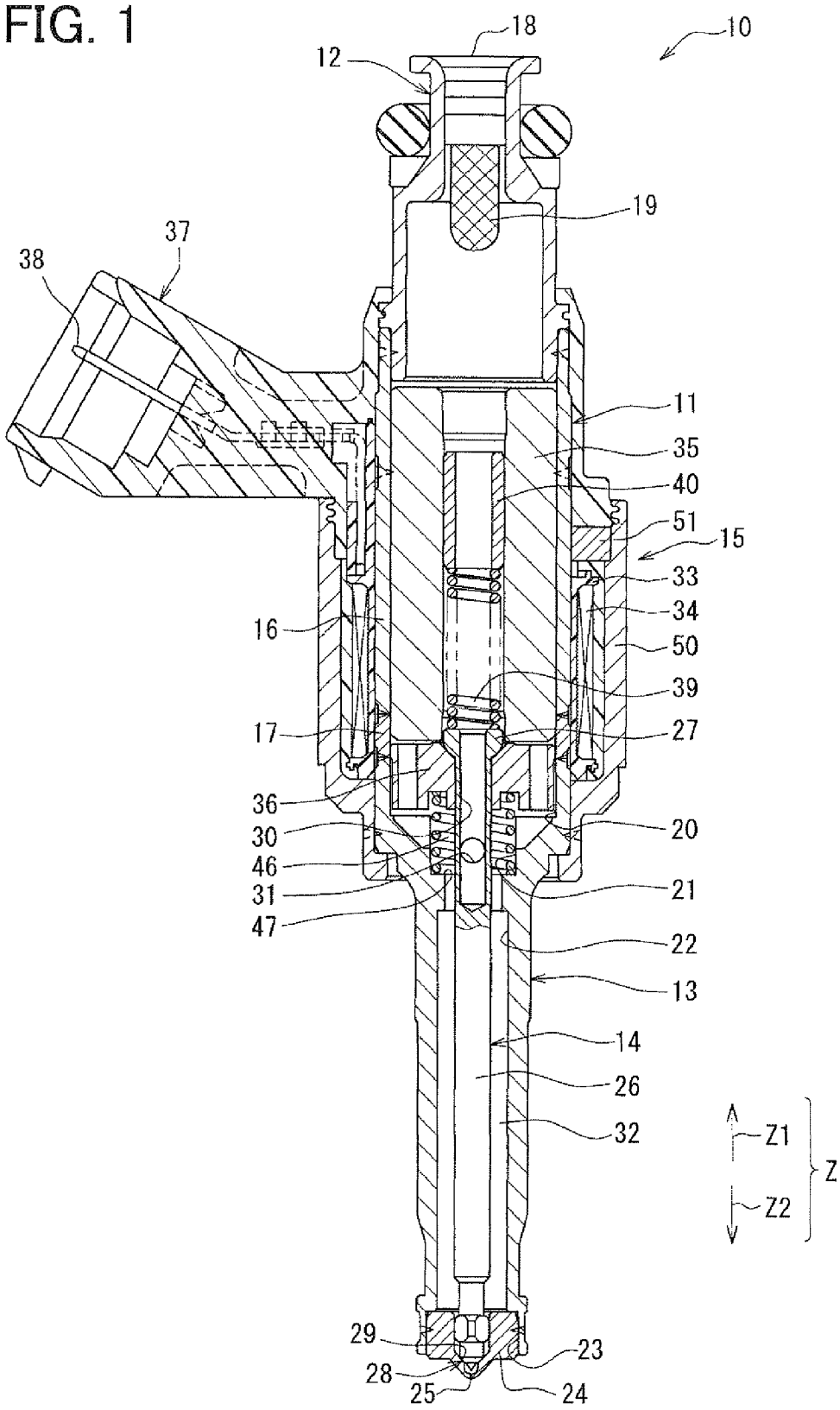
FIG. 1 is a longitudinal sectional view illustrating an entire structure of an injector according to a first embodiment of the invention.

An injector 10 illustrated in FIG. 1 is an fuel injection valve, and applied for example, to a direct injection type gasoline engine. When the injector 10 is applied to the direct injection type gasoline engine, the injector 10 is disposed in an engine head (not shown).

The injector 10 includes a cylindrical member 11, an inlet member 12, a nozzle holder 13, a needle 14, and a driving unit 15. The cylindrical member 11 extends in a predetermined axial direction Z (opening and closing direction). The inlet member 12 is disposed at one end part of the cylindrical member 11 in the axial direction Z of the cylindrical member 11. The nozzle holder 13 is disposed at the other end part of the cylindrical member 11 in the axial direction Z of the cylindrical member 11. The needle 14 is accommodated in the injector 10 so as to reciprocate inside the injector 10 in the axial direction Z. The driving unit 15 drives the needle 14.

To describe a direction of the injector 10, a direction in which the cylindrical member 11 extends is hereinafter referred to as the axial direction Z (up-and-down direction in FIG. 1). Then, one side of the axial direction Z is referred to as a valve opening direction Z1 (i.e., upper side in FIG. 1, or one side of the injector 10 which is opposite from a nozzle hole), and the other side of the axial direction Z is referred to as a valve closing direction Z2 (i.e., lower side in FIG. 1, or nozzle hole side).

The cylindrical member 11 is formed in a cylindrical shape, whose inner diameter is generally the same in the axial direction Z. The cylindrical member 11 includes a magnetic portion 16 that has magnetism and a nonmagnetic portion 17 that does not have magnetism. The magnetic portion 16 is located on the valve opening direction Z1 side of the nonmagnetic portion 17. Accordingly, an end portion of the cylindrical member 11 in the valve closing direction Z2 is the nonmagnetic portion 17. The nonmagnetic portion 17 is for preventing a magnetic short circuit between the magnetic portion 16 and the nozzle holder 13 (described in greater detail hereinafter). The magnetic portion 16 and the nonmagnetic portion 17 are integrally connected, for example, by laser welding. The cylindrical member 11 may be partly magnetized or nonmagnetized for example, by thermal processing, after being integrally formed. The nonmagnetic portion 17 may have a magnetism reducing portion whose thickness is thinner than the magnetic portion 16.

The inlet member 12 is provided at an end portion of the cylindrical member 11 in the valve opening direction Z1. The inlet member 12 is cylindrically formed, and press-fitted into an inner circumference of the cylindrical member 11. The inlet member 12 includes a fuel inlet 18 passing therethrough in the axial direction Z. Fuel is supplied into the fuel inlet 18 from a fuel pump (not shown). A fuel filter 19 is disposed in the fuel inlet 18. The fuel filter 19 removes foreign substances included in fuel. Accordingly, the fuel which has been supplied into the fuel inlet 18 flows into the inner circumference of the cylindrical member 11 through the fuel filter 19.

The nozzle holder 13 is cylindrically formed, and provided at an end portion of the cylindrical member 11 in the valve closing direction Z2 The nozzle holder 13 has magnetism. Accordingly, the nonmagnetic portion 17 of the cylindrical member 11 is located between the magnetic portion 16 and the nozzle holder 13 having magnetism in the axial direction Z.

The nozzle holder 13 includes a large diameter portion 20, an intermediate diameter portion 21, a small diameter portion 22, and an attachment portion 23, whose inner diameters are different from each other. The diameter portions 20 to 23 are formed such that their central axes are generally coaxial. The large diameter portion 20 of the three diameter portions 20 to 22 has the largest inner diameter. The intermediate diameter portion 21 has the second largest inner diameter after the large diameter portion 20. The small diameter portion 22 has the smallest inner diameter. As regards a positional relationship among the three diameter portions 20 to 22, the large diameter portion 20 is located at an end portion of the nozzle holder 13 in the valve opening direction Z1, and then the intermediate diameter portion 21 and the small diameter portion 22 are arranged in the valve closing direction Z2. The inner diameter of the large diameter portion 20 is generally the same as the inner diameter of the cylindrical member 11, and the large diameter portion 20 is located so as to be generally coaxial with the cylindrical member 11. The attachment portion 23 is formed at an end portion of the small diameter portion 22 in the valve closing direction Z2. Accordingly, an end portion of the nozzle holder 13 in the valve closing direction Z2 is the attachment portion 23. A nozzle body 24 is provided in the attachment portion 23.

The nozzle body 24 is cylindrically formed, and fixed to the attachment portion 23 of the nozzle holder 13, for instance, by press-fitting or welding. An inner wall surface of the nozzle body 24 is inclined such that an inner diameter of the nozzle body 24 becomes smaller in the valve closing direction Z2, and formed in a peaked shape. A nozzle hole 25 is formed at a front end portion of such a nozzle body 24. The nozzle hole 25 passes through the nozzle body 24 in the axial direction Z to communicate between an inner wall surface and an outer wall surface of the nozzle body 24. An inner wall surface of the nozzle body 24 around the nozzle hole 25 functions as a valve seat 29.

A structure that is composed of the cylindrical member 11, the inlet member 12, the nozzle holder 13, and the nozzle body 24, which are described above, corresponds to a cylindrical "housing" having the nozzle hole 25 on its one end side and the fuel inlet 18, which is a fuel introducing port, on its other end side.

The needle 14 is an elongated "valve member" that extends in the axial direction Z, and accommodated in the inner circumferences of the cylindrical member 11, the nozzle holder 13, and the nozzle body 24 so as to reciprocate in the axial direction Z. The needle 14 opens and closes the nozzle hole 25 as a result of the reciprocative displacement of the needle 14 in the axial direction Z so as to inject and stop injecting fuel through the nozzle hole 25. The needle 14 is arranged generally coaxially with the nozzle body 24. The needle 14 includes a shaft portion 26 that may correspond to a shaft-shaped portion, a stopper 27 that may correspond to a stopper portion, and a sealing portion 28.

The shaft portion 26 is an elongated member of circular cross section, and is a main body portion of the needle 14. The stopper 27 is formed at an end portion of the shaft portion 26 in the valve opening direction Z1, to project radially outward in a flanged manner along the whole circumference of the stopper 27. The sealing portion 28 is formed at an end portion of the shaft portion 26 in the valve closing direction Z2, and chamfered along the valve seat 29 of the nozzle body 24. The sealing portion 28 is engageable with the valve seat 29.

The needle 14 has an inflow hole 30 and a communicating hole 31 that correspond to a feeding passage for fuel supplied toward a fuel passage 32, which is formed between the small diameter portion 22 of the nozzle holder 13 and the needle 14, and the nozzle hole 25.

More specifically, the inflow hole 30 constitutes an upstream passage of the feeding passage, and is formed by a drilling process from an end face of the stopper 27 of the needle 14 in the valve opening direction Z1 to a halfway region of the shaft portion 26. In other words, the inflow hole 30 opens in the valve opening direction Z1, and is closed in the valve closing direction Z2.

The communicating hole 31 constitutes a downstream passage of the feeding passage, and is formed as a circular hole passing through a wall portion of the inflow hole 30 at a halfway region of the inflow hole 30 on its closed side in a direction that intersects with the inflow hole 30 (direction perpendicular to the inflow hole 30 in the present example). The above-described communicating hole 31 is one of more than one communicating hole 31 along the periphery of the inflow hole 30, and two communicating holes 31 are axisymmetrically formed in the present example. The communicating hole 31 that is illustrated in FIG. 1, and a communicating hole that is on the face or field of FIG. 1 as opposed to this communicating hole 31 and not illustrated in FIG. 1 (communicating hole having the same shape as the illustrated communicating hole 31), are formed on the needle 14.

As illustrated in FIG. 1, a diameter (e.g., 1.4 mm) of the communicating hole 31 that is circular in cross section is smaller than a diameter (e.g., 1.6 mm) of the inflow hole 30 that is circular in cross section. Nevertheless, by forming more than one communicating hole 31, a gross cross-sectional area of the communicating holes 31 is larger than a cross-sectional area of the inflow hole 30. Accordingly, a cross-sectional area of the downstream passage of the feeding passage is larger than a cross-sectional area of the upstream passage of the feeding passage.

A spherical surface portion 271 that projects toward a movable core 36 is formed on the stopper 27 of the needle 14. The spherical surface portion 271 is a main feature of the present embodiment, and is described in greater detail hereinafter.

The driving unit 15 will be described below with reference to FIG. 2 in addition to FIG. 1. The driving unit 15 drives the needle 14 in the axial direction Z, and includes a spool 33, a coil 34, a connector 37, a fixed core 35, a magnetic plate 50, an upper magnetic plate 51, the movable core 36, a first spring 39, a second spring 46, the nozzle holder 13, and the cylindrical member 11.

The spool 33 is disposed radially outward of the cylindrical member 11. The spool 33 is made of resin and formed cylindrically, and the coil 34 is wound on an outer peripheral surface of the spool 33. Upon energization of the coil 34, the coil 34 generates magnetic force in the fixed core 35 to attract the movable core 36 to the fixed core 35. The coil 34 is electrically connected to a terminal 38 of the connector 37. The terminal 38 is electrically connected to an external electric circuit (not shown) attached to the connector 37, so that a state of energization of the coil 34 is controlled by the external electric circuit.

The fixed core 35 is fixed at a predetermined setting position which is located radially inward of the coil 34 with the cylindrical member 11 between the fixed core 35 and the coil 34. The fixed core 35 is cylindrically formed from a magnetic material such as iron, and fixed on an inner peripheral surface of the cylindrical member 11 by press-fitting, for example.

The magnetic plate 50 is formed from a magnetic material, and disposed to cover an outer peripheral surface of the coil 34. The upper magnetic plate 51 is made of a magnetic material, and disposed to cover an end portion of the coil 34 in the valve opening direction Z1 (on the one side of the injector 10 opposite from the nozzle hole 25). A cylindrical adjusting pipe 40 is fixed by press-fitting on an inner peripheral surface of the fixed core 35 in the valve opening direction Z1.

The movable core 36 is disposed radially inward of the cylindrical member 11 and radially inward of the large diameter portion 20 of the nozzle holder 13 so as to reciprocate in the axial direction Z. The movable core 36 is formed cylindrically from a magnetic material such as iron. An insertion hole (corresponding to a "central hole") 41 that passes through the movable core 36 in the axial direction Z is formed at a radially central part of the movable core 36. An inner diameter of the insertion hole 41 is slightly larger than an outer diameter of the shaft portion 26 of the needle 14.

An outer peripheral surface portion 43 of the movable core 36, which is a radially outward portion of the movable core 36 is in contact with an inner peripheral surface portion 44 of the cylindrical member 11. In the present embodiment, the outer peripheral surface portion 43, which is in contact with the inner peripheral surface portion 44, is formed as a projecting portion 43. The projecting portion 43 is formed at an end portion of the movable core 36 in the valve opening direction Z1. A part of the cylindrical member 11, with which the projecting portion 43 is in contact, corresponds to the nonmagnetic portion 17. Accordingly, the projecting portion 43 is displaced in the axial direction Z, being in contact with the inner peripheral surface portion 44 of the nonmagnetic portion 17. Therefore, the movable core 36 and the nonmagnetic portion 17 slide on each other. As a result, the displacement of the movable core 36 in the axial direction Z is guided by the nonmagnetic portion 17 with sliding resistance (frictional force) constantly generated.

A tapered portion 361, which is recessed in the valve closing direction Z2, is formed on an end face portion 45 (hereinafter referred to as an upper end face portion 45) of the movable core 36 in its valve opening direction Z1. The tapered portion 361 is a main feature of the present embodiment, and is described in greater detail hereinafter.

The shaft portion 26 of the needle 14 is inserted in the insertion hole 41 of the movable core 36 so that the needle 14 is movable through the insertion hole 41 in the axial direction Z. An outer peripheral surface portion 42 of the shaft portion 26 is in contact with the insertion hole 41. Accordingly, the needle 14 is displaced in the axial direction Z, being in contact with the movable core 36. Therefore, the needle 14 and the movable core 36 slide on each other. As a result, the displacement of the needle 14 in the axial direction Z is guided by the movable core 36, with sliding resistance (frictional force) constantly generated due to the contact of the needle 14 with the movable core 36.

The first spring 39 is a "resilient member" which is disposed inside the fixed core 35. One end portion of the first spring 39 is in contact with the stopper 27 of the needle 14, and the other end portion of the first spring 39 is in contact with the adjusting pipe 40. The first spring 39 has force to extend in the axial direction Z. Thus, the movable core 36 and the needle 14 are pressed in the valve closing direction Z2, in which they engage with the valve seat 29, by the first spring 39. A load of the first spring 39 is adjusted through the regulation of the press fit amount of the adjusting pipe 40. When the coil 34 is not energized, the movable core 36 and the needle 14 are pressed in the valve closing direction Z2, so that the sealing portion 28 is engaged with the valve seat 29.

An outer diameter of the stopper 27 of the needle 14 is larger than the inner diameter of the insertion hole 41, and the stopper 27 is in contact with the upper end face portion 45 (tapered portion 361) of the movable core 36. Accordingly, the stopper 27 limits the displacement of the movable core 36 in the valve opening direction Z1. More specifically, between the movable core 36 and the needle 14, the displacement of the needle 14 in the valve closing direction Z2 (i.e., toward the valve seat 29), and relative movement of the movable core 36 toward the fixed core 35, are limited as a result of the contact between the stopper 27 and the tapered portion 361. Therefore, the stopper 27 limits undue relative displacement between the movable core 36 and the needle 14. In addition, the outer diameter of the stopper 27 is smaller than an inner diameter of the fixed core 35, and the stopper 27 reciprocates along the axial direction Z radially inward of the cylindrically-shaped fixed core 35.

The second spring 46 is a "resilient member" which is disposed radially inward of the large diameter portion 20 and the intermediate diameter portion 21 of the nozzle holder 13. The second spring 46 has force to extend in the axial direction Z. An end portion of the second spring 46 in the valve opening direction Z1 is in contact with an end portion 48 (hereinafter referred to as a lower end face portion 48) of the movable core 36 in the valve closing direction Z2. An end portion of the second spring 46 in the valve closing direction Z2 is in contact with a stepped surface portion 47, which is a connecting portion between the intermediate diameter portion 21 and the small diameter portion 22. The inner diameter of the intermediate diameter portion 21 is slightly larger than an outer diameter of the second spring 46. By such an intermediate diameter portion 21, inclination and bend of the second spring 46 are reduced. As a result, pressing force of the second spring 46 is accurately maintained.

The movable core 36 is urged by stress to be pressed toward the fixed core 35 (i.e., in the valve opening direction Z1) because of the above-described second spring 46. Valve closing force f1 in the valve closing direction Z2 is applied to the movable core 36 by the first spring 39 via the needle 14, and valve opening force f2 in the valve opening direction Z1 is applied to the movable core 36 by the second spring 46. In order to facilitate understanding, FIG. 2 illustrates only directions in which the valve closing force f1 and the valve opening force f2 are applied, instead of a region of the movable core 36 to which the valve closing force f1 and the valve opening force f2 are actually applied.

The valve closing force f1, which is pressing force of the first spring 39, is set to be larger than the valve opening force f2, which is the pressing force of the second spring 46. Therefore, in a valve closing state in which the energization of the coil 34 is stopped, the needle 14 in contact with the first spring 39 is displaced in the valve closing direction Z2 (i.e., toward the nozzle hole 25) against the valve opening force f2 of the second spring 46 along with the movable core 36 in contact with the stopper 27. As a result, in the valve closing state, the sealing portion 28 of the needle 14 is engaged with the valve seat 29.

Both downstream ends of the communicating holes 31 of the needle 14 open into a region between the lower end face portion 48 of the movable core 36 and the stepped surface portion 47 of the nozzle holder 13 in the axial direction Z. More specifically, the communicating holes 31 are formed such that opening positions of the downstream ends of the communicating holes 31 are located between the lower end face portion 48 and the stepped surface portion 47 regardless of a position of the needle 14 in accordance with the reciprocative displacement of the needle 14 in the axial direction Z to open and close the nozzle hole 25.

The downstream ends of the communicating holes 31 communicate with the fuel passage 32. Accordingly, the fuel, which has flowed down radially inward of the fixed core 35 through the fuel filter 19, flows into the inflow hole 30 inside the needle 14, and is then guided out of the needle 14 through the communicating holes 31 that are formed at a lower end portion of the inflow hole 30. After that, the fuel flows down through the fuel passage 32 to flow in toward the nozzle hole 25.

Figure 2:
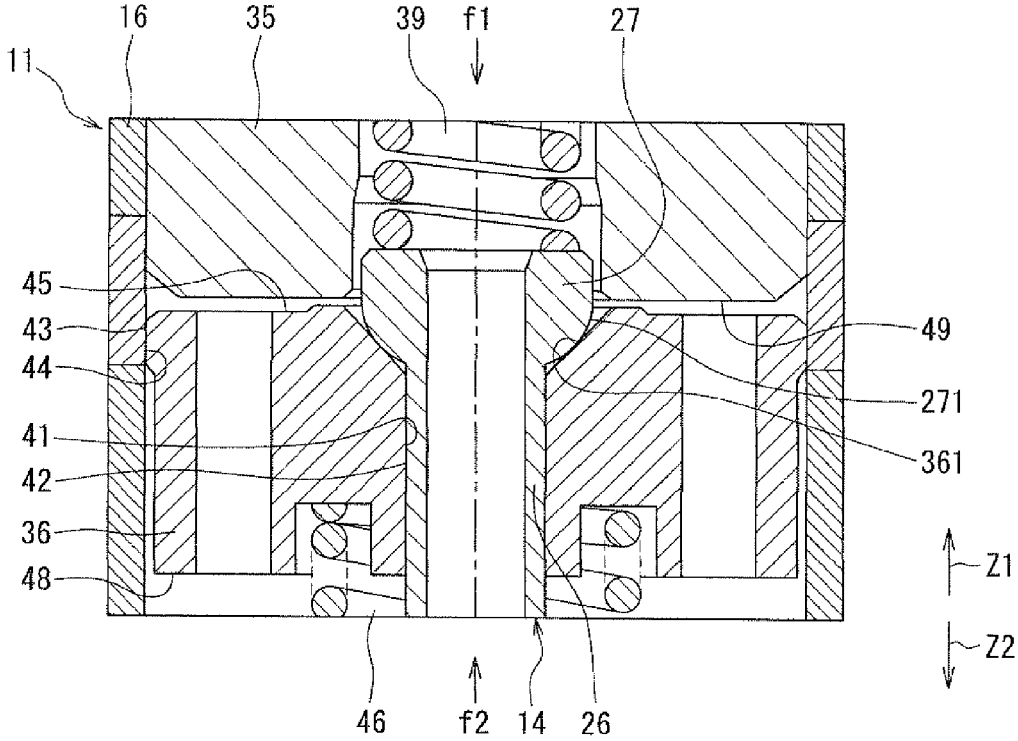
FIG. 2 is a longitudinal sectional view illustrating structure of a main feature of the injector according to the first embodiment.
Figure 3:
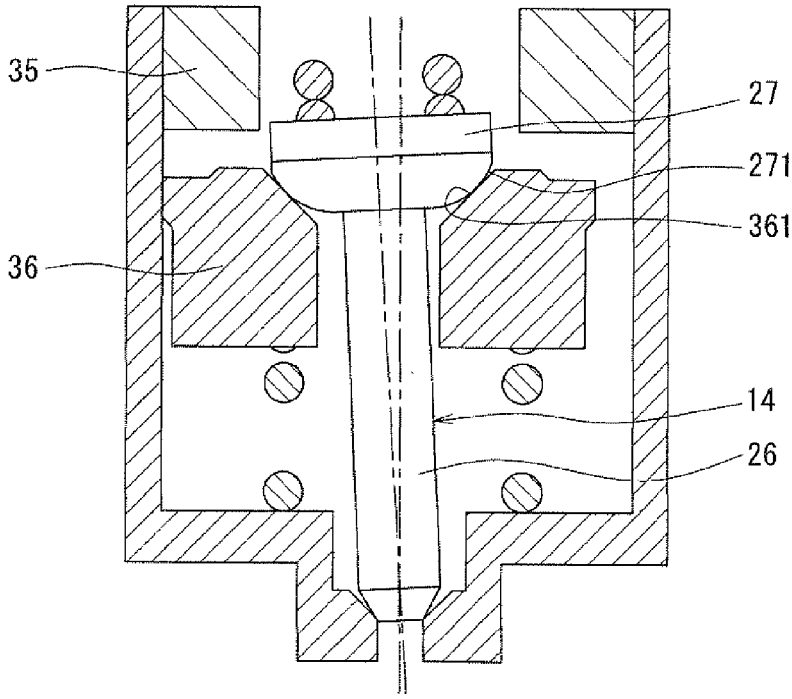
FIG. 3 is a longitudinal sectional view roughly illustrating inclination of a needle according to the first embodiment.

In the present embodiment, as illustrated in FIG. 2, the spherical surface portion 271 is formed on the stopper 27 of the needle 14, and the tapered portion 361 is formed on the upper end face portion 45 of the movable core 36.

The formations of the spherical surface portion 271 and the tapered portion 361 are provided based on the following concept. That is, the stopper 27 and the movable core 36 make contact between two inclined surfaces that are inclined in the same direction relative to an axis of the shaft portion 26, and furthermore, at least one of both these two inclined surfaces is formed to be a curved surface that projects toward the other one.

Specifically, a surface of the stopper 27 on the movable core 36 side is first assumed to be an inclined surface (corresponding to a "stopper inclined surface") which is inclined toward the movable core 36 as well as toward the axis of the shaft portion 26. In other words, this surface of the stopper 27 on the movable core 36 side is assumed to be a conically-shaped inclined surface that is inclined from an outer peripheral surface of the stopper 27 toward the shaft portion 26 and projects toward the movable core 36. This inclined surface is formed as a curved surface that projects toward the movable core 36. In the present example, the curved surface is a spherical surface, and this spherical surface is formed as the spherical surface portion 271.

Moreover, an inclined surface (corresponding to a "movable core inclined surface") is formed on the upper end face portion 45 of the movable core 36, along an assumed inclined surface, based on which the spherical surface portion 271 is formed. In other words, an inclined surface in a shape of a mortar that is recessed in the valve closing direction Z2 (i.e., in the direction opposite from the stopper 27) is formed on the upper end face portion 45, and this inclined surface serves as the tapered portion 361. In the present example, the tapered portion 361 does not have such a curved surface as the spherical surface portion 271, and the tapered portion 361 is a flat inclined surface.

Operation of the injector 10 as a result of the above-described structure will be described below.

First, the operation of the injector 10 when the injector 10 opens the nozzle hole 25 is explained. When the energization of the coil 34 is stopped, magnetic attraction force is not generated between the fixed core 35 and the movable core 36. Accordingly, the needle 14 is pressed in the valve closing direction Z2 by the valve closing force f1, which is the pressing force of the first spring 39. Meanwhile, the stopper 27 of the needle 14 is in contact with the upper end face portion 45 of the movable core 36. For this reason, the movable core 36 is displaced together with the needle 14 further in the valve closing direction Z2 than in a valve opening state of the movable core 36 due to a difference between the valve closing force f1 of the first spring 39 and the valve opening force f2, which is the pressing force of the second spring 46. Thus, the movable core 36 is away from the fixed core 35. As a result of the displacement of the needle 14 further in the valve closing direction Z2 than in the valve opening state, the sealing portion 28 of the needle 14 is engaged with the valve seat 29. Therefore, fuel is not injected through the nozzle hole 25.

Upon energization of the coil 34 in the above valve closing state, a magnetic flux flows and a magnetic circuit is formed through the magnetic plate 50, the upper magnetic plate 51, the magnetic portion 16, the fixed core 35, the movable core 36, and the nozzle holder 13 because of a magnetic field generated in the coil 34. Consequently, the magnetic attraction force is generated between the fixed core 35 and the movable core 36. When a sum of the magnetic attraction force, which is generated between the fixed core 35 and the movable core 36, and the valve opening force f2 of the second spring 46 becomes larger than the valve closing force f1 of the first spring 39, the movable core 36 starts to move in the valve opening direction Z1. Meanwhile, since the stopper 27 is in contact with the upper end face portion 45 of the movable core 36, the needle 14 moves in the valve opening direction Z1 along with the movable core 36. As a consequence, the sealing portion 28 of the needle 14 is disengaged from the valve seat 29.

As described above, the fuel, which has flowed into the injector 10 through the fuel inlet 18, flows into the fuel passage 32 through the fuel filter 19, a radially inward portion of the inlet member 12, a radially inward portion of the adjusting pipe 40, a radially inward portion of the fixed core 35, the inflow hole 30, the communicating holes 31, and a radially inward portion of the intermediate diameter portion 21 in this order. The fuel which has flowed into the fuel passage 32 flows into the nozzle hole 25 through between the needle 14, which is disengaged from the valve seat 29, and the nozzle body 24. Accordingly, fuel is injected through the nozzle hole 25.

As above, not only the magnetic attraction force but also the valve opening force f2 of the second spring 46 is applied to the movable core 36. Hence, upon energization of the coil 34, the movable core 36 and the needle 14 are displaced quickly in the valve opening direction Z1 by the produced magnetic attraction force. As a consequence, operational responsivity of the needle 14 to the energization of the coil 34 is improved. Furthermore, the magnetic attraction force needed to drive the movable core 36 and the needle 14 is reduced. Therefore, the driving unit 15, such as the coil 34, is downsized.

As above, when the magnetic attraction force is applied in the valve closing state, the movable core 36 and the needle 14 are displaced integrally in the valve opening direction Z1 because of the contact between the upper end face portion 45 of the movable core 36 and the stopper 27. The movable core 36 moves in the valve opening direction Z1 until the upper end face portion 45 collides with a lower end face portion 49 of the fixed core 35. When the movable core 36 collides with the fixed core 35, because the movable core 36 and the needle 14 are displaced relatively in the axial direction Z, the stopper 27 of the needle 14 disengages from the upper end face portion 45 due to inertia force in the valve opening direction Z1, and the needle 14 still continues to move in the valve opening direction Z1. In the above-described manner, even though the stopper 27 is disengaged, the stopper 27 is maintained in a state of its contact with the first spring 39. Accordingly, the stopper 27 does not collide with any other members whatsoever. Thus, the needle 14 does not bound, so that irregular injection of fuel through the nozzle hole 25 is reduced.

Moreover, when the needle 14 continues to move in the valve opening direction Z1 because of the inertia force in the valve opening direction Z1 and then the movable core 36 and the stopper 27 are separated, the valve opening force f2 of the second spring 46 via the movable core 36 is not applied to the needle 14. Consequently, only the pressing valve closing force f1 of the first spring 39 is applied to the needle 14. In other words, when the movable core 36 and the needle 14 are disengaged from each other, the force that is applied to the needle 14 in the valve closing direction Z2 becomes large. Therefore, the excessive displacement of the needle 14 in the valve opening direction Z1 is limited, so that overshoot of the needle 14 is reduced.

Likewise, when the needle 14 continues to move in the valve opening direction Z1 because of the inertia force in the valve opening direction Z1 and then the movable core 36 and the needle 14 are separated, the valve opening force f2 of the second spring 46 and the magnetic attraction force are applied, whereas the valve closing force f1 of the first spring 39 is not applied to the movable core 36. In other words, when the movable core 36 is disengaged from the stopper 27, force that is applied in the valve opening direction Z1 to the movable core 36 becomes large. Therefore, when the movable core 36 collides with the fixed core 35, the movable core 36 does not bounce in the valve closing direction Z2 due to an impact of the collision, and a state of the contact of the movable core 36 with the fixed core 35 is maintained at least while the coil 34 is being energized.

Impactive force when the movable core 36 collides with the fixed core 35 becomes small because the weight that produces the impactive force is reduced (because only the weight of the movable core 36 creates the impactive force). Because of such small impactive force, it is very difficult for the movable core 36 to bound in the valve closing direction Z2.

When the needle 14 overshoots so that the force applied to the needle 14 is equal to the valve closing force f1 alone, a movement speed of the needle 14 in the valve opening direction Z1 decreases and then the needle 14 stops to maximize its overshoot amount. After that, the needle 14 starts to move in the valve closing direction Z2 by the valve closing force f1. On the other hand, the movable core 36 is in a state in which the movable core 36 is in contact with the fixed core 35 due to the magnetic attraction force and the valve opening force f2 of the second spring 46. Accordingly, when the needle 14 moves in the valve closing direction Z2, the displacement of the needle 14 in the valve closing direction Z2 is restricted by the movable core 36 which is in contact with the fixed core 35. As a result, the magnetic attraction force and the valve opening force f2 of the second spring 46 are applied to the needle 14 again, and thereby the needle 14 maintains the valve opening state. Since the movable core 36 and the needle 14 are relatively movable as described above, the irregular injection of fuel through the nozzle hole 25 because of the bounce of the needle 14 is reduced. Thus, even if a period of the energization of the coil 34 is short, the injection quantity of fuel injected through the nozzle hole 25 is accurately controlled.

Next, the operation of the injector 10 when the injector 10 closes the nozzle hole 25 is explained. When the energization of the coil 34 is stopped in the valve opening state, the magnetic attraction force between the fixed core 35 and the movable core 36 disappears. Consequently, the needle 14 starts to move in the valve closing direction Z2 along with the movable core 36 by the valve closing force f1 of the first spring 39. Therefore, the sealing portion 28 of the needle 14 is engaged with the valve seat 29 again, so that the flow of fuel between the fuel passage 32 and the nozzle hole 25 is closed. As a result, the injection of fuel is ended.

When the energization of the coil 34 is stopped, the movable core 36 and the needle 14 are displaced in the valve closing direction Z2 by the valve closing force f1 of the first spring 39 against the valve opening force f2 of the second spring 46. When the sealing portion 28 of the needle 14 is engaged with the valve seat 29, the needle 14 bounds in the valve opening direction Z1 as a result of its impact of collision with the valve seat 29. Because the movable core 36 and the needle 14 are relatively movable, even after the sealing portion 28 engages with the valve seat 29, the movable core 36 still continues to move in the valve closing direction Z2 due to inertia force in the valve closing direction Z2. As a consequence, the movable core 36 and the needle 14 are separated.

For these reasons, only the valve closing force f1 of the first spring 39 is applied to the needle 14, and only the valve opening force f2 of the second spring 46 is applied to the movable core 36. Accordingly, as a result of the separation of the movable core 36 and the needle 14, resultant force applied to the needle 14 equals the valve closing force f1 alone, so that the bound of the needle 14 in the valve opening direction Z1 is prevented. Therefore, when the energization of the coil 34 is stopped, the fuel injection through the nozzle hole 25 is rapidly stopped. Eventually, the irregular injection of fuel is reduced, and the injection quantity of fuel injected through the nozzle hole 25 is accurately controlled.

Impactive force when the needle 14 collides with the valve seat 29 becomes small because the weight that produces the impactive force is reduced (because only the weight of the needle 14 creates the impactive force). Because of such small impactive force, it is very difficult for the needle 14 to bound in the valve opening direction Z1.

In addition, when the needle 14 is engaged with the valve seat 29, the movable core 36, which is movable relatively to the needle 14, overpowers the valve opening force f2 of the second spring 46 that urges the movable core 36 in the valve opening direction Z1 because of inertia force in the valve closing direction Z2. The movable core 36 is unduly displaced further in the valve closing direction Z2, in other words, the movable core 36 undershoots.

When the movable core 36 undershoots so that the force applied to the movable core 36 is equal to the valve opening force f2 alone, a movement speed of the movable core 36 in the valve closing direction Z2 decreases and then the movable core 36 stops to maximize its undershoot amount. After that, the movable core 36 starts to move in the valve opening direction Z1 by the valve opening force f2. On the other hand, the needle 14 is in a state in which its sealing portion 28 is engaged with the valve seat 29 due to the valve closing force f1 of the first spring 39. Accordingly, the stopper 27 of the needle 14 limits the displacement of the movable core 36, which is moving in the valve opening direction Z1 by the valve opening force f2. The movable core 36 is stopped and put in the valve closing state where the following valve opening operation can be started.

In the present embodiment, the spherical surface portion 271 is formed on the stopper 27 of the needle 14, and the tapered portion 361 is formed on the upper end face portion 45 of the movable core 36. Because of this, in the above-described sliding operation of the needle 14 and the movable core 36 in the axial direction Z, even if inclination of the needle 14 with reference to the movable core 36 is produced as illustrated in FIG. 3, a contact region between the movable core 36 and the stopper 27 is relatively shifted, and the whole circumferential contact between the spherical surface portion 271 and the tapered portion 361 is maintained. As a result, the generation of wear due to the one-sided contact as in the conventional technology is prevented.

Furthermore, the curved surface, which is provided for the assumed inclined surface of the stopper 27, is a spherical surface (spherical surface portion 271). Hence, a contact state between the spherical surface portion 271 and the tapered portion 361 is maintained to be constantly the same, so that the displacement of the needle 14 from the axial direction is limited.

Moreover, because the spherical surface portion 271 is provided for the stopper 27, and the tapered portion 361 is provided for the movable core 36, production of the spherical surface portion 271 on the needle 14 and production of the tapered portion 361 on the movable core 36 are facilitated.

Modifications of the first embodiment will be described below. In the first embodiment, the spherical surface portion 271 is formed on the stopper 27 of the needle 14, and the tapered portion 361 is formed on the upper end face portion 45 of the movable core 36. Alternatively, a flat inclined surface may be left for the stopper 27, and a curved surface (e.g., spherical surface) may be formed on the inclined surface (tapered portion 361) of the movable core 36. Furthermore, in addition to the first embodiment, a curved surface (e.g., spherical surface) may be formed on the tapered portion 361 of the movable core 36 as well, so that both the needle 14 and the movable core 36 are given inclined surfaces having curved surfaces.

Moreover, as the inclined surfaces provided for the stopper 27 and the movable core 36, a conically-shaped inclined surface that projects from the upper end face portion 45 toward the stopper 27 may be formed on the movable core 36, and an inclined surface in a shape of a mortar that is recessed in the valve opening direction Z1 may be formed on the stopper 27. The curved surface may be provided for each inclined surface in the following manner. That is, the curved surface may be given, as described above, to the stopper 27, to the movable core 36, or to both the stopper 27 and the movable core 36. In addition, the curved surface which is given to the inclined surface is not necessarily a spherical surface, and may be a curved surface with any curvature.

(Second Embodiment)

Similar to the first embodiment, in a second embodiment of the invention, an outer peripheral surface portion 42 of a shaft portion 26 that extends in an axial direction of a needle 14 is slidably guided by an inner peripheral surface portion 410 of an insertion hole 41 that passes through a radially central part of a movable core 36 in the axial direction. The outer peripheral surface portion 42 has a cylindrical surface which extends straight in the axial direction of the needle 14 and whose diameter does not change. The inner peripheral surface portion 410 has a cylindrical surface which extends straight in the axial direction of the movable core 36 and whose diameter does not change. Accordingly, as illustrated with emphasis in FIG. 4, an inner clearance 70, which is located radially inward of the movable core 36, is formed radially as a slide clearance between the outer peripheral surface portion 42 and the inner peripheral surface portion 410.

The outer peripheral surface portion 42 of the shaft portion 26 of the second embodiment includes a recessed surface portion 420 around an axis 260 of the shaft portion 26. This recessed surface portion 420 is recessed radially inward on the needle 14, and expands in the axial direction from a boundary 262 (see FIG. 5) between the shaft portion 26 and a stopper 27 (more specifically, a stopper inclined surface 272 described hereinafter), in a valve closing direction Z2 (i.e., toward a nozzle hole 25). Accordingly, in the second embodiment, the inner clearance 70 is defined between the outer peripheral surface portion 42 of the shaft portion 26 including the recessed surface portion 420, and the inner peripheral surface portion 410 of the insertion hole 41. In addition, in the second embodiment, corresponding to the recessed surface portion 420 of the shaft portion 26, a shallow recessed surface portion 411 is formed on the inner peripheral surface portion 410 of the insertion hole 41. This recessed surface portion 411 is recessed radially outward, and expands in the axial in the valve closing direction Z2 from an end portion of the movable core 36 in a valve opening direction Z1 (i.e., end portion on the opposite side of the nozzle hole 25). However, the recessed surface portion 411 does not need to be formed.

Similar to the first embodiment, in the second embodiment, a projecting portion 43 (corresponding to a "sliding surface"), which is an outer peripheral surface portion of an end portion of the movable core 36 in the valve opening direction Z1 (i.e., end portion on the opposite side of the nozzle hole 25), is slidably guided by an inner peripheral surface portion 44 (corresponding to a "guiding surface") of a nonmagnetic portion 17 that constitutes a cylindrical member 11. The projecting portion 43 serves as the cylindrical surface which extends straight in the axial direction of the movable core 36 and whose diameter does not change with the exception of a chamfered portion at a leading end of the movable core 36 in the valve opening direction Z1. The inner peripheral surface portion 44 includes a cylindrical surface, which extends straight in the axial direction and whose diameter does not change, on the cylindrical member 11. In consequence, as illustrated with emphasis in FIG. 4, an outer clearance 72, which is located radially outward of the movable core 36, is formed radially as a slide clearance between the projecting portion 43 and the inner peripheral surface portion 44.

Figure 4:
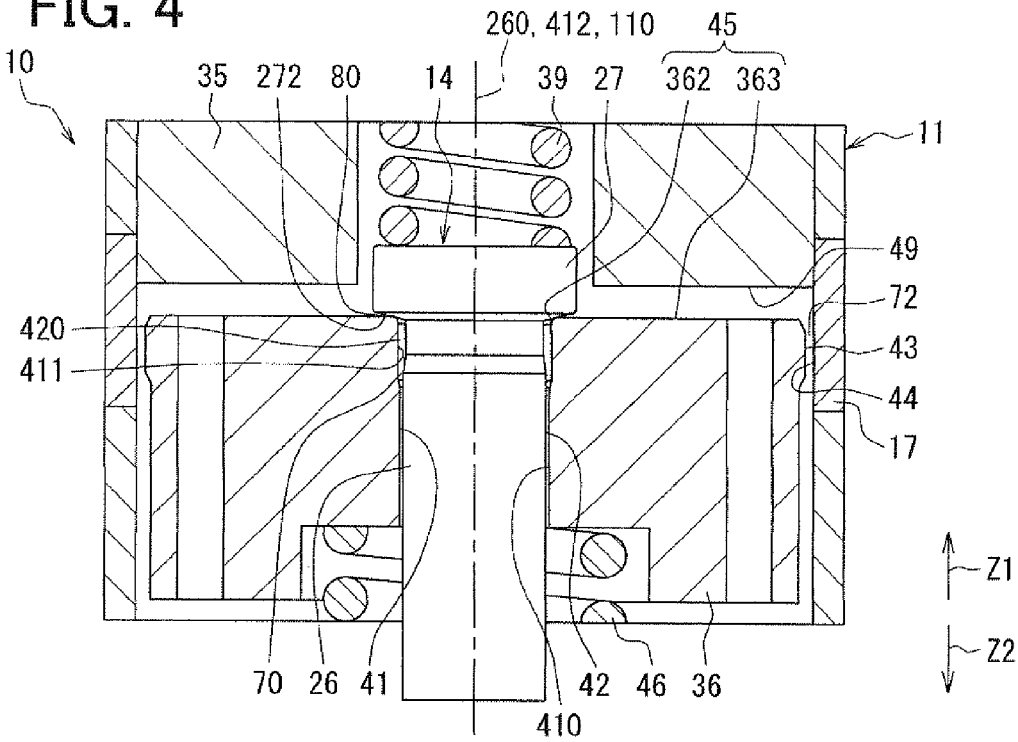
FIG. 4 is a longitudinal sectional view illustrating structure of a main feature of an injector according to a second embodiment of the invention.
Figure 5:
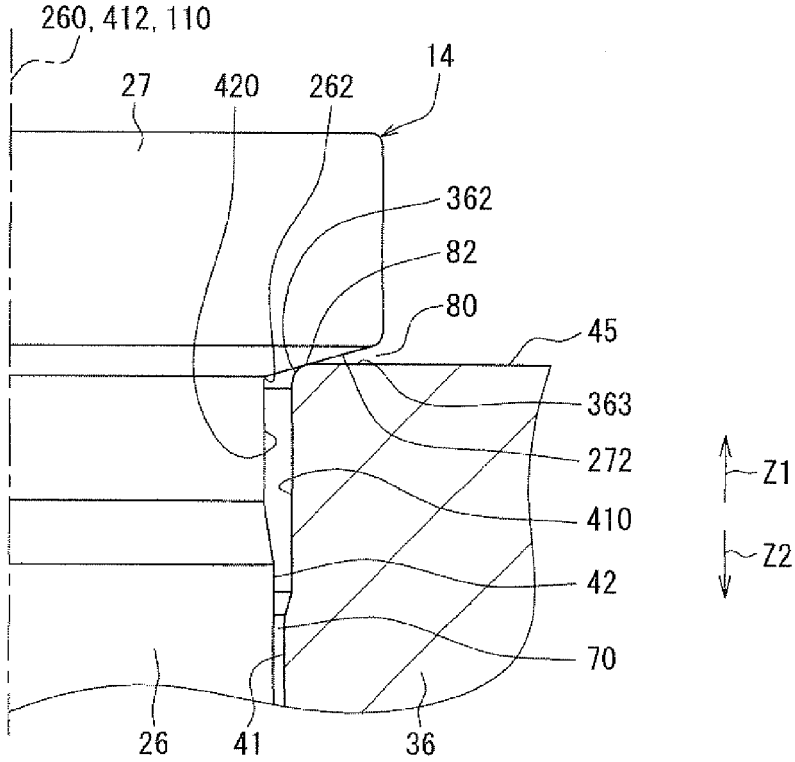
FIG. 5 is an enlarged longitudinal sectional view illustrating a characterizing portion of the injector according to the second embodiment.

Furthermore, similar to the first embodiment, in the second embodiment, the conically-shaped stopper inclined surface 272, which is inclined from an outer circumferential side of the stopper 27 toward the shaft portion 26 and which projects toward the movable core 36, is formed on a surface of the stopper 27 opposed to the movable core 36 illustrated in FIGS. 4 and 5. More specifically, the stopper inclined surface 272 is formed around the axis 260 of the shaft portion 26, such that the surface 272 inclines radially inward of the stopper 27 further in the valve closing direction Z2 of an axial direction Z. The stopper inclined surface 272 of the second embodiment is formed in a shape of an easily-formable flat inclined surface, i.e., in a shape of such a tapered surface that a diameter of the tapered surface is reduced further in the valve closing direction Z2 and this diameter reduction ratio is constant in the axial direction, instead of the spherically-shaped curved surface as in the first embodiment. The "diameter reduction ratio" means a variation of a diameter, which reduces further in the direction of the nozzle hole 25 of the axial direction Z, per unit axial distance.

Moreover, similar to the first embodiment, in the second embodiment, a movable core inclined surface 362 in a shape of a mortar, which is recessed in the valve closing direction Z2, is formed on an end face portion 45 of the movable core 36 in the valve opening direction Z1 (on the opposite side of the nozzle hole 25). More specifically, the movable core inclined surface 362 is formed around an axis 412 of the insertion hole 41, such that the surface 362 inclines radially outward of the movable core 36 further in the valve opening direction Z1 of the axial direction Z. The movable core inclined surface 362 of the second embodiment is formed in a form of a spherically-shaped curved surface, i.e., in a shape of a curved surface having such an R-section that a diameter of the R-section is reduced further in the valve closing direction Z2 and this diameter reduction ratio decreases further in the above direction Z2, instead of a shape of the flat inclined surface as in the first embodiment. As a result, according to the movable core 36 of the second embodiment, the inner clearance 70 is defined also between the movable core inclined surface 362 and the recessed surface portion 420 of the shaft portion 26, with the movable core inclined surface 362 that has a shape of the curved surface in contact with the stopper inclined surface 272 having a shape of the tapered surface.

Additionally, as is evident from FIGS. 2 and 4, in the second embodiment, similar to the first embodiment, a movable core opposed surface 363, which is opposed to the stopper inclined surface 272 (in the first embodiment, the spherical surface portion 271 serving as the stopper inclined surface) in the axial direction, is formed on the end face portion 45 of the movable core 36, radially outward of the movable core inclined surface 362 (in the first embodiment, the tapered portion 361 serving as a movable core inclined surface). More specifically, the movable core opposed surface 363 is formed around the axis 412 of the insertion hole 41 to evenly expand in a radial direction of the insertion hole 41, and connected to the inner peripheral surface portion 410 of the insertion hole 41 via the movable core inclined surface 362 in this radial direction. In consequence, in the second embodiment, radially outward of a contact portion 82 (see FIG. 5) between the movable core inclined surface 362 and the stopper inclined surface 272, a clearance 80, which separates the movable core opposed surface 363 and the stopper inclined surface 272 in the axial direction, is formed reliably along the whole circumference of the contact portion 82.

Similar to the first embodiment, in the second embodiment, as illustrated in FIG. 4, on the movable core 36 that is located in the valve closing direction Z2 in a normal attitude in which the axis 412 of the insertion hole 41 is not inclined with respect to an axis 110 of the inner peripheral surface portion 44 of the cylindrical member 11, the movable core opposed surface 363 is opposed in the axial direction to a lower end face portion 49 of a fixed core 35, which is located in the valve opening direction Z1. Because of this, when the movable core 36 is magnetically attracted to the fixed core 35 in accordance with the fuel injection, the movable core 36 is brought into contact with the lower end face portion 49 along the whole circumference of the movable core 36, with the axial clearance 80 secured between the movable core opposed surface 363 and the stopper inclined surface 272.

Figure 6:
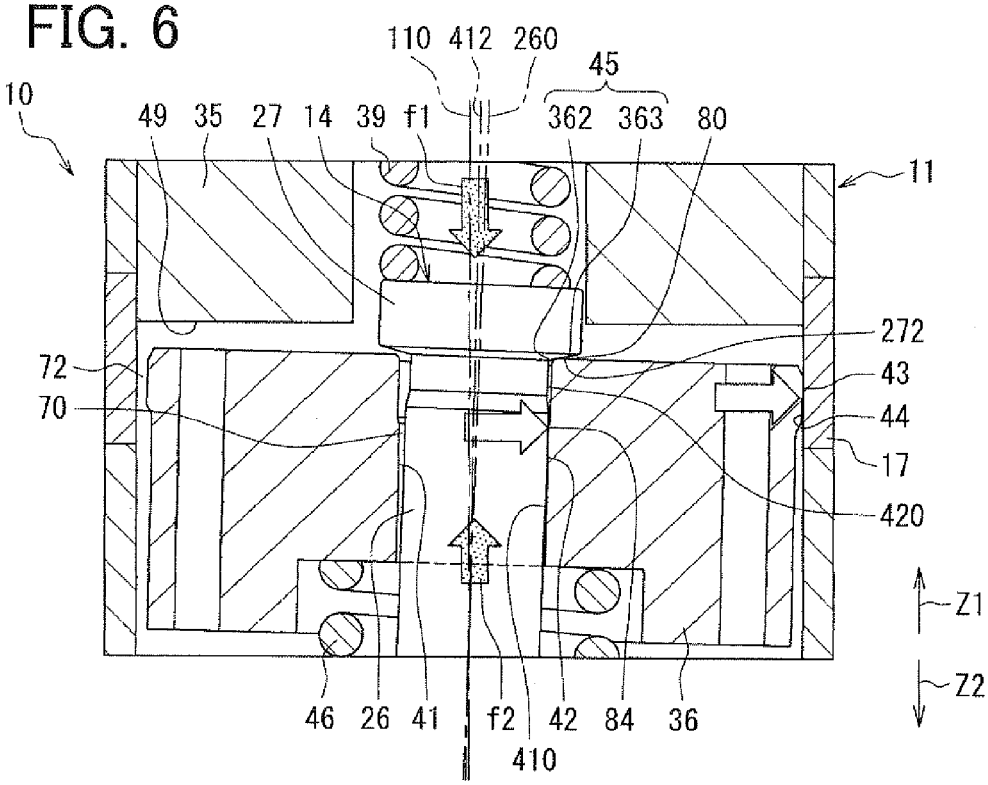
FIG. 6 is a longitudinal sectional view illustrating operation of the injector according to the second embodiment.

In an injector 10 of the second embodiment having the is above-described structure, the radial clearances 70, 72 exist respectively at a radially inward portion of the movable core 36, in which the shaft portion 26 of the needle 14 is inserted and at a radially outward portion of the movable core 36, which is guided by the cylindrical member 11. For this reason, the needle 14 is prone to the inclination with reference to the cylindrical member 11 and the movable core 36 as illustrated in FIG. 6. Also, in the second embodiment, the stopper inclined surface 272 of the stopper 27, which projects from the shaft portion 26 of the needle 14 radially outward of the shaft portion 26, is pressed against the movable core 36 by valve closing force (pressing force) f1 of a first spring 39. Thus, this movable core 36 also tends to incline in accordance with the inclination of the needle 14 in FIG. 6.

While the movable core 36 is in an inclined state in accordance with the needle 14, the outer peripheral surface portion 42 of the shaft portion 26 is pressed, due to the force f1 of the first spring 39, against the inner peripheral surface portion 410 of the insertion hole 41 of the movable core 36, on the direction Z2-side of the recessed surface portion 420. On the same side as the above pressing direction (i.e., on the right-hand side of the axis 412 of the insertion hole 41 as illustrated with an outline arrow in FIG. 6), the projecting portion 43, which is the outer peripheral surface of the movable core 36, is pressed, due to the force f1 of the first spring 39, on the inner peripheral surface portion 44 of the nonmagnetic portion 17 of the cylindrical member 11. As a result, torque Fr in a direction to return the inclined movable core 36 back into the normal attitude, is generated as indicated by an arrow with an alternate long and two short dashes line in FIG. 7. The torque Fr is a force to rotate the movable core 36 around a contact point 84 between the inner peripheral surface portion 410 and the outer peripheral surface portion 42, on a side on which the outer peripheral surface portion 42 is pressed on the inner peripheral surface portion 410 of the movable core 36, and on which the projecting portion 43 of the movable core 36 is pressed on the inner peripheral surface portion 44 (i.e., on the right-hand side of the axis 412 in FIGS. 6 and 7; hereinafter referred to simply as a "pressed side of the shaft portion 26 and the projecting portion 43").

Figure 7:
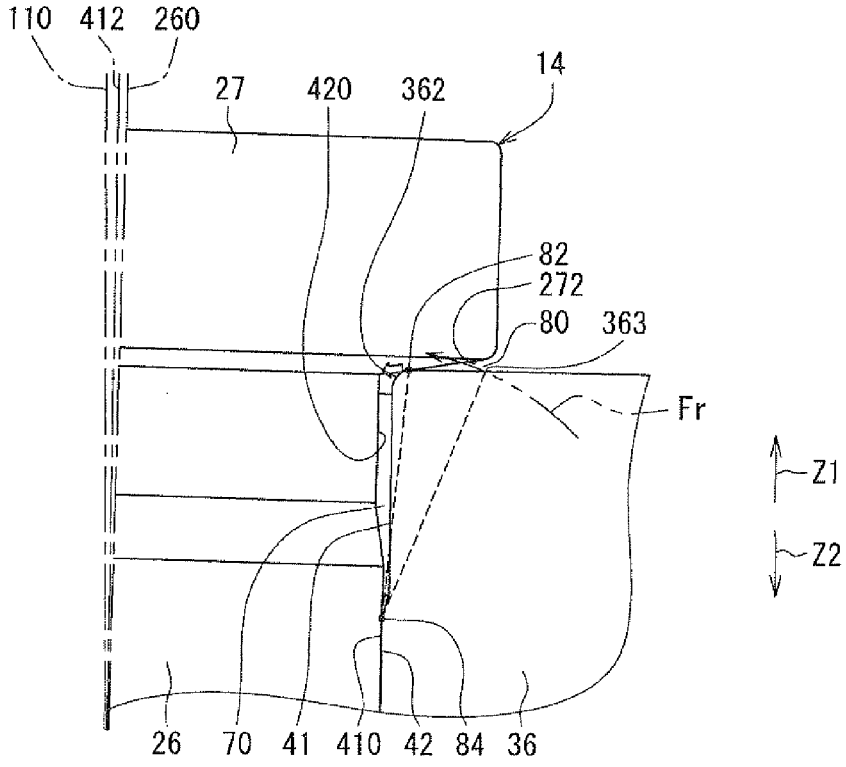
FIG. 7 is a diagram illustrating the operation of the injector according to the second embodiment.
Figure 8:
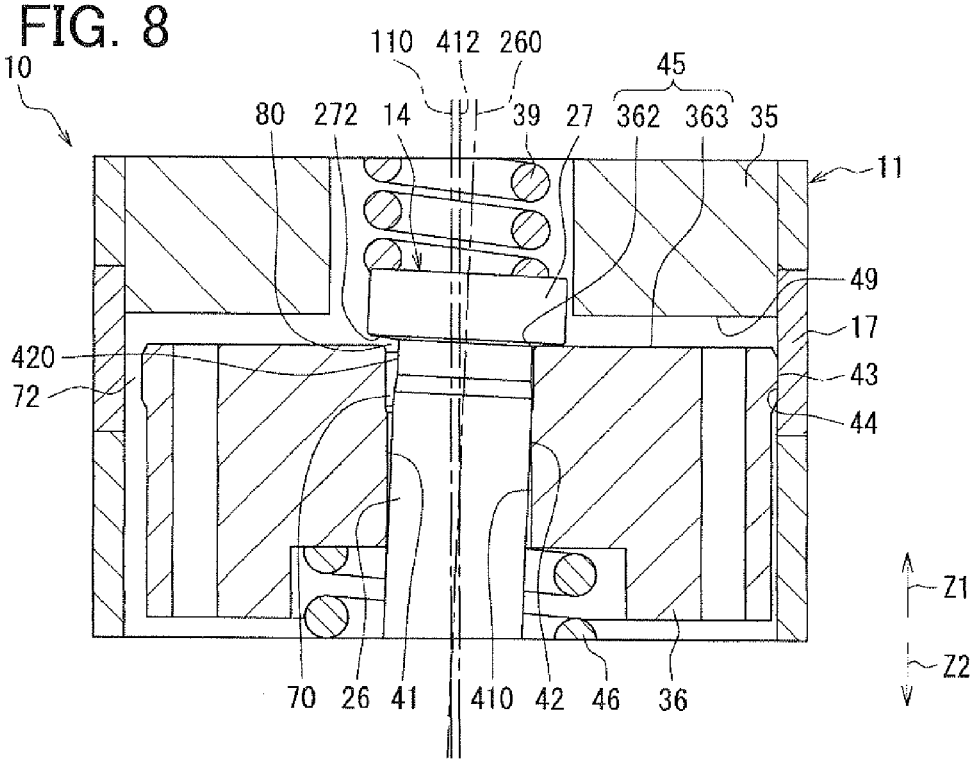
FIG. 8 is a longitudinal sectional view illustrating the operation of the injector according to the second embodiment.

As illustrated in FIG. 7, on the pressed side of the shaft portion 26 and the projecting portion 43, the movable core 36, to which the torque Fr is applied in a direction of the normal attitude, rotates so as to displace the contact portion 82 between the movable core 36 and the stopper inclined surface 272 radially inward of the movable core 36, and to reduce the axial clearance 80 between the movable core 36 and the stopper inclined surface 272. Meanwhile, by virtue of the stopper inclined surface 272, which is inclined radially inward of the stopper 27 in the valve closing direction Z2 and on which the movable core inclined surface 362 is pressed by valve opening force (pressing force) f2 of a second spring 46, the contact portion 82 can be displaced readily and quickly along this surface 272, with the contact point 84 shifted in the direction Z2. In the second embodiment in particular, since the inner clearance 70 is ensured between the surfaces 362, 410 of the movable core 36, and the recessed surface portion 420 even on the pressed side of the shaft portion 26 and the projecting portion 43, the radially inward displacement of the contact portion 82 is ensured. As well, especially in the second embodiment, both the projecting portion 43 and the inner peripheral surface portion 44, which are in contact with each other by the pressing, are formed in a shape of a cylindrical surface that is flat in the axial direction. As a consequence, as illustrated in FIG. 8, the movable core 36 rotates until the projecting portion 43 conforms with the inner peripheral surface portion 44, i.e., until the axial direction of the movable core 36 coincides with the axial direction of the cylindrical member 11 (nevertheless, the axis 412 is slightly eccentric to the axis 110).

Because of the above-described principle, even though the movable core 36 is inclined in conformity with the needle 14, the movable core 36 is returned by itself into the normal attitude without this inclination. Accordingly, when opening the nozzle hole 25, the movable core 36 is brought into contact with the fixed core 35 on the magnetically attracting side, along the whole circumference of the movable core 36, so that the generation of wear due to the one-sided contact is prevented. Thus, the highly-reliable injector 10 is provided.

FIGS. 9 to 13 illustrate structures of main features of injectors 10 in accordance with third to seventh embodiments of the invention.

(Third Embodiment)

Figure 9:
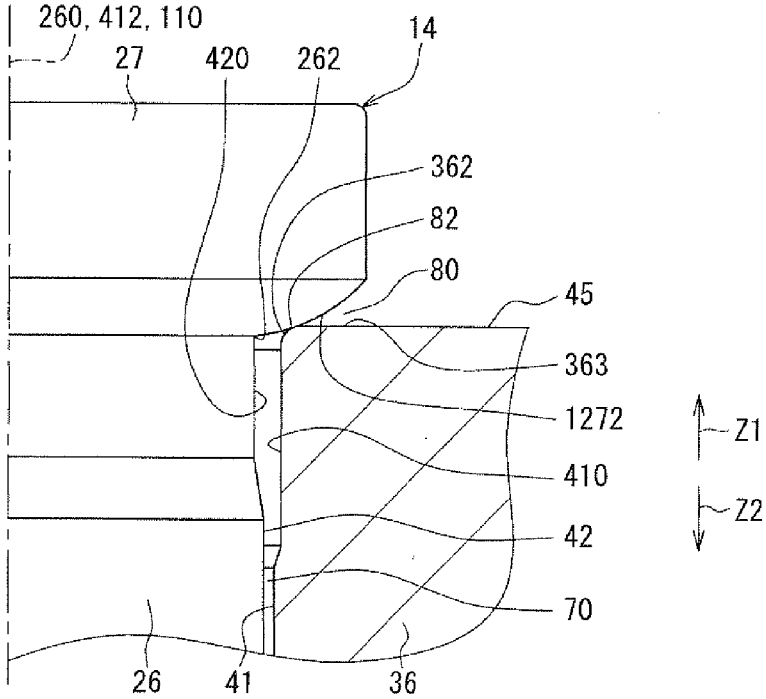
FIG. 9 is an enlarged longitudinal sectional view illustrating a characterizing portion of an injector according to a third embodiment of the invention.

As illustrated in FIG. 9, in the third embodiment of the invention as a modification of the second embodiment, a stopper inclined surface 1272, which is provided on a surface of a stopper 27 on a movable core 36 side, is formed in a form of the spherically-shaped curved surface in accordance with the first embodiment instead of the shape of the flat inclined surface. More specifically, the stopper inclined surface 1272, which inclines radially inward of the stopper 27 further in a valve closing direction Z2 of an axial direction Z, is formed around an axis 260 of a shaft portion 26 as a curved surface having an R-section. A diameter of the R-section is reduced further in the valve closing direction Z2, and this diameter reduction ratio increases further in the valve closing direction Z2. Accordingly, a movable core inclined surface 362 of the movable core 36 in the shape of a curved surface is in contact with the stopper inclined surface 1272 in the shape of a curved surface, and an axial clearance 80 is thereby defined between the movable core 36 and the stopper inclined surface 1272 radially outward of this contact portion 82.

(Fourth Embodiment)

Figure 10:
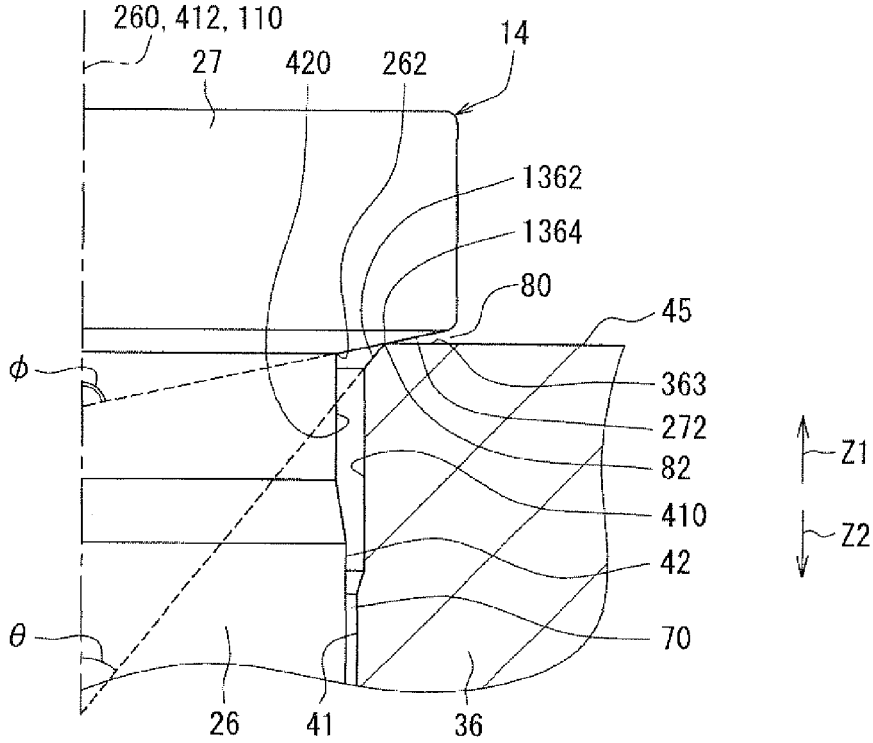
FIG. 10 is an enlarged longitudinal sectional view illustrating a characterizing portion of an injector according to a fourth embodiment of the invention.

As illustrated in FIG. 10, in the fourth embodiment as a modification of the second embodiment, a movable core inclined surface 1362, which is provided on an end face portion 45 of a movable core 36, is formed in a shape of an easily-formable flat inclined surface in accordance with the first embodiment, instead of the form of the spherically-shaped curved surface. More specifically, the movable core inclined surface 1362, which inclines radially outward of the movable core 36 further in a valve opening direction Z1 of an axial direction Z, is formed as a tapered surface around an axis 412 of an insertion hole 41. A diameter of this tapered surface is reduced further in a valve closing direction Z2 of the axial direction Z, and the diameter reduction ratio is constant in the axial direction. An inclination angle θ of the movable core inclined surface 1362 with respect to the axis 412, is smaller than an inclination angle ϕ of a stopper inclined surface 272 with respect to an axis 260 of a shaft portion 26. As a result of the above-described structure, a boundary corner portion 1364 of the movable core 36 between the movable core inclined surface 1362 in the shape of a tapered surface and a movable core opposed surface 363 in the shape of a flat surface, is in contact with the stopper inclined surface 272 having the shape of a tapered surface, and an axial clearance 80 is thereby defined between the movable core 36 and the stopper inclined surface 272 radially outward of a contact portion 82 at this corner portion 1364.

(Fifth Embodiment)

Figure 11:
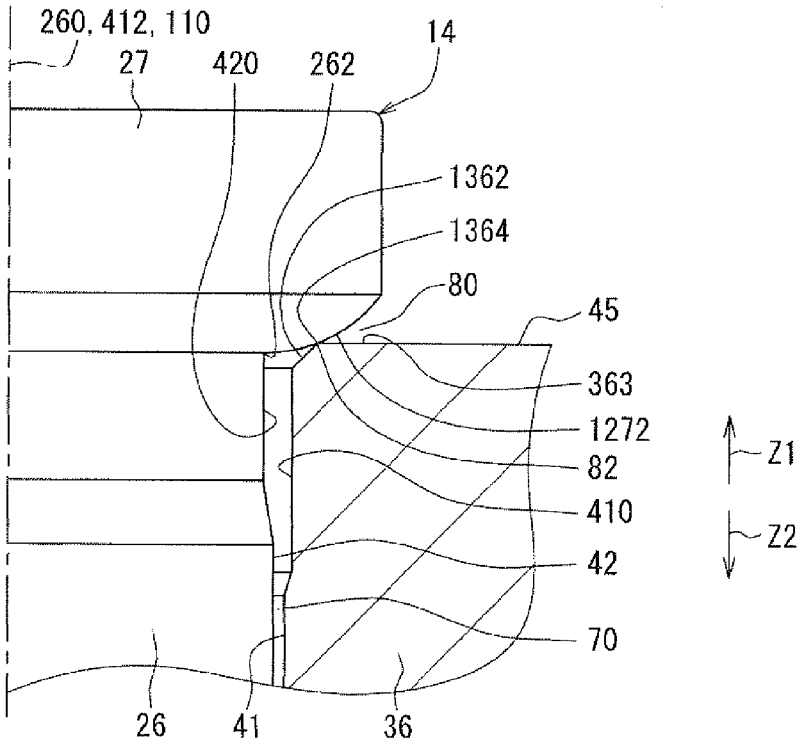
FIG. 11 is an enlarged longitudinal sectional view illustrating a characterizing portion of an injector according to a fifth embodiment of the invention.

As illustrated in FIG. 11, in the fifth embodiment, the stopper inclined surface 1272 of the third embodiment and the movable core inclined surface 1362 of the fourth embodiment are combined. As a consequence, a boundary corner portion 1364 of a movable core 36 between the movable core inclined surface 1362 in the shape of a tapered surface and a movable core opposed surface 363 in the shape of a flat surface is in contact with the stopper inclined surface 1272 in the shape of a curved surface, and an axial clearance 80 is thereby defined between the movable core 36 and the inclined surface 1272 radially outward of this contact portion 82.

(Sixth Embodiment)

Figure 12:
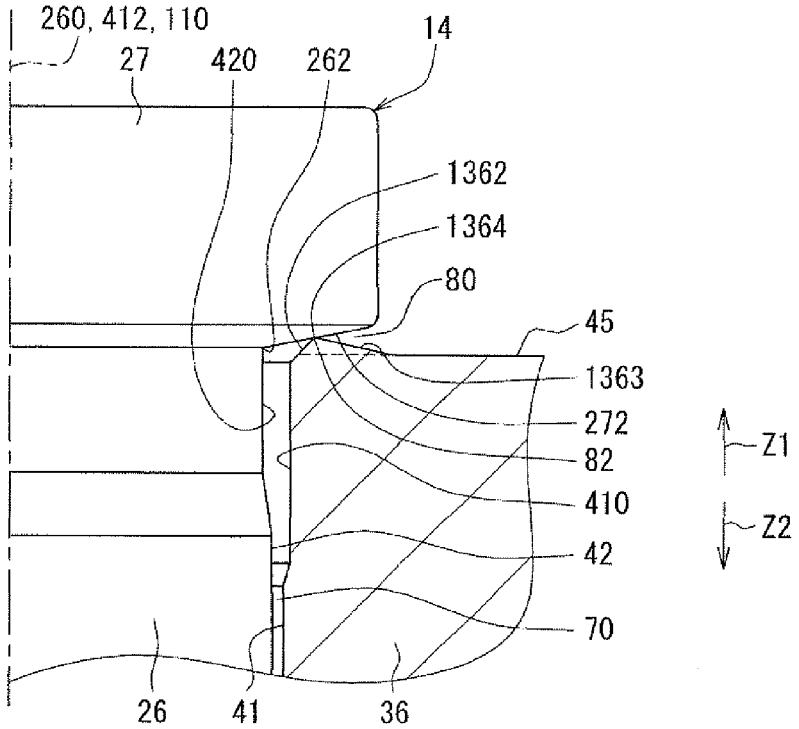
FIG. 12 is an enlarged longitudinal sectional view illustrating a characterizing portion of an injector according to a sixth embodiment of the invention.

As illustrated in FIG. 12, in the sixth embodiment as a modification of the fourth embodiment, a movable core opposed surface 1363, which is provided on an end face portion 45 of a movable core 36, is formed in a shape of a flat inclined surface, instead of the shape of a radially-spreading flat plane. More specifically, the movable core opposed surface 1363, which inclines further radially inward of the movable core 36 in a valve opening direction Z1, is formed as a tapered surface around an axis 412 of an insertion hole 41. A diameter of this tapered surface is reduced further in the direction Z1, and the diameter reduction ratio is constant in the axial direction. As a result, a boundary corner portion 1364 of the movable core 36 between a movable core inclined surface 1362 in the shape of a tapered surface and the movable core opposed surface 1363 in the shape of a tapered surface is in contact with a stopper inclined surface 272 having the shape of a tapered surface, and an axial clearance 80 is thereby defined between the movable core 36 and the stopper inclined surface 272 radially outward of this contact portion 82.

(Seventh Embodiment)

Figure 13:
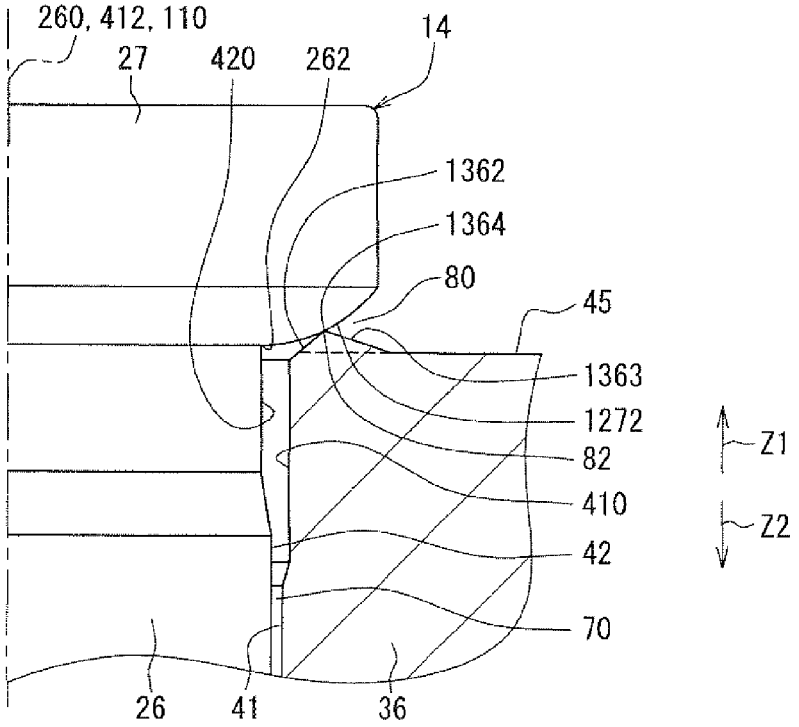
FIG. 13 is an enlarged longitudinal sectional view illustrating a characterizing portion of an injector according to a seventh embodiment of the invention.

As illustrated in FIG. 13, in the seventh embodiment, the stopper inclined surface 1272 of the third embodiment, the movable core inclined surface 1362 of the fourth embodiment, and the movable core opposed surface 1363 of the sixth embodiment are combined. Hence, a boundary corner portion 1364 of a movable core 36 between the movable core inclined surface 1362 in the shape of a tapered surface and the movable core opposed surface 1363 in the shape of a tapered surface is in contact with the stopper inclined surface 1272 in the shape of a curved surface, and an axial clearance 80 is thereby defined between the movable core 36 and the inclined surface 1272 radially outward of this contact portion 82.

By any of the above-described third to seventh embodiments, the movable core 36 is automatically rotated such that the contact portion 82 is displaced radially inward and the axial clearance 80 is reduced on the pressed side of the shaft portion 26 and the projecting portion 43, and the position of the movable core 36 is thereby returned back into the normal attitude. For this reason, when opening the nozzle hole 25, the movable core 36 is brought into contact with the fixed core 35 on the magnetically attracting side, along the whole circumference of the movable core 36, so that the generation of wear due to the one-sided contact is prevented. Accordingly, the highly-reliable injector 10 is produced.

Modifications of the above embodiments will be described below. The embodiments of the invention have been described above. However, the invention is not by any means limited to those embodiments, and may be embodied through various modifications without departing from the scope of the invention.

For example, in the above second to seventh embodiments, the recessed surface portion 420 does not need to be formed on the outer peripheral surface portion 42 of the shaft portion 26. In the second to seventh embodiments, the projecting portion 43 may be formed not only on the end portion of the movable core 36 in the valve opening direction Z1 (i.e., end portion on the opposite side of the nozzle hole 25), but also on the direction Z2 side of this end portion.

Figure 14:
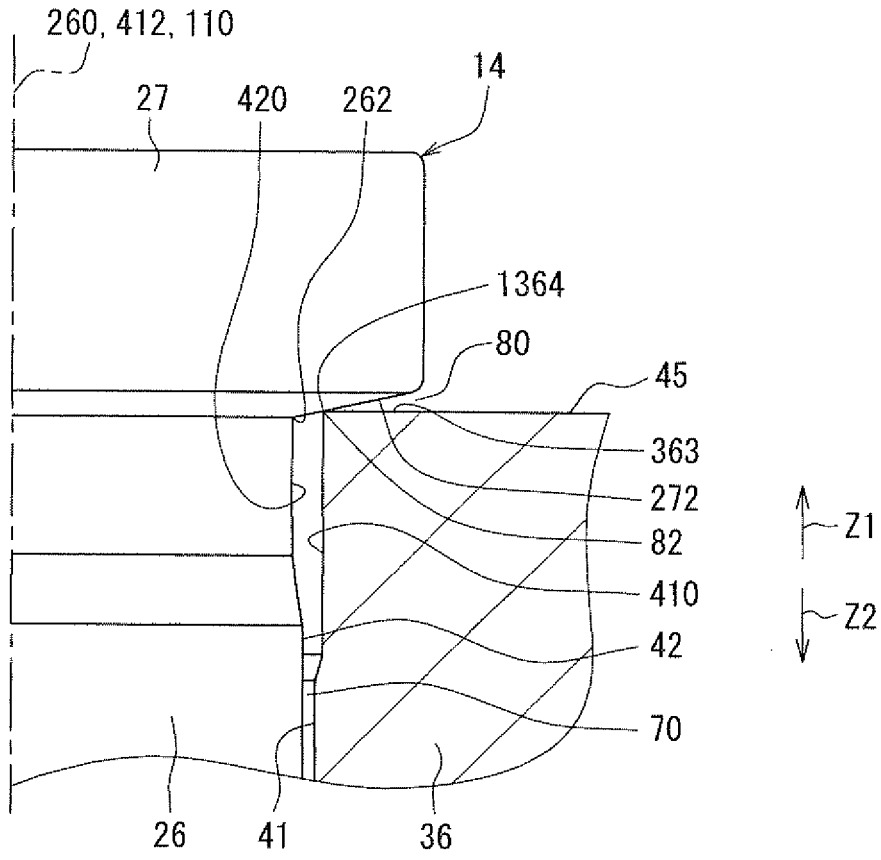
FIG. 14 is an enlarged longitudinal sectional view illustrating a characterizing portion of a modification of the injector according to the fourth embodiment.
Figure 15A:
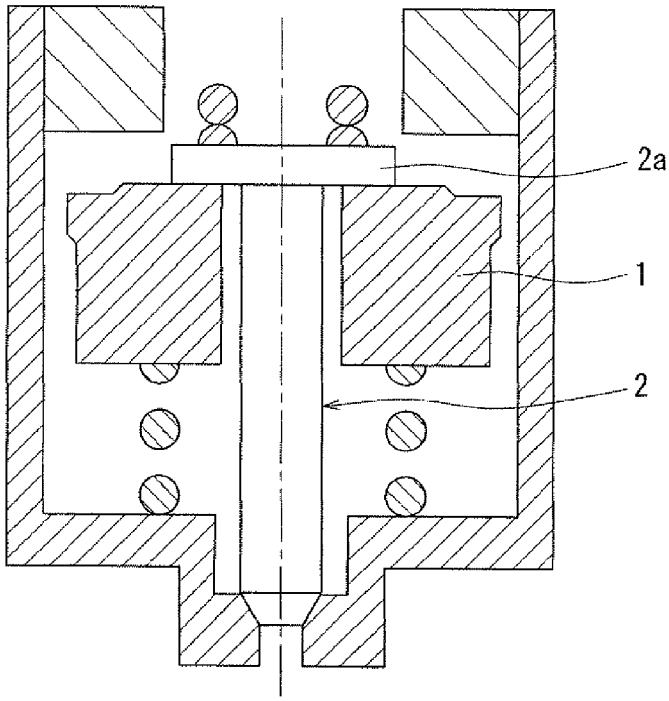
FIG. 15A PRIOR ART
FIG. 15A is a longitudinal sectional view roughly illustrating a moving core and a needle in accordance with a conventional technology with the needle uninclined.
Figure 15B:
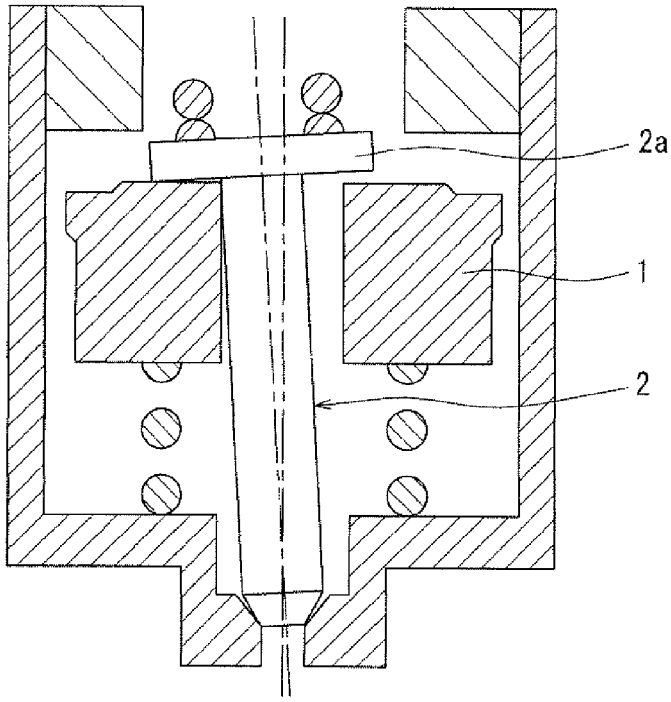
FIG. 15B PRIOR ART
FIG. 15B is a longitudinal sectional view roughly illustrating the moving core and the needle in accordance with the conventional technology with the needle inclined.
Figure 16:
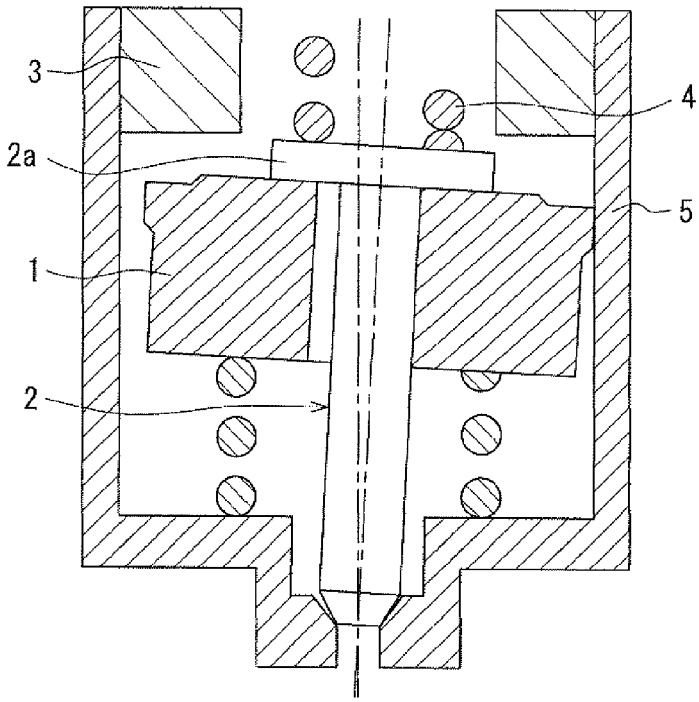
FIG. 16 PRIOR ART
FIG. 16 is a longitudinal sectional view roughly illustrating the moving core and the needle in accordance with the conventional technology.
Figure 17:
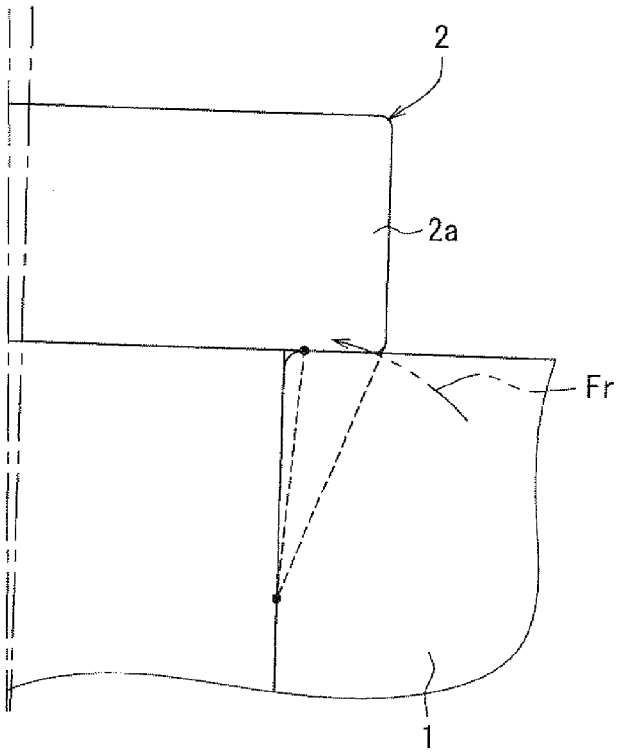
FIG. 17 PRIOR ART
FIG. 17 is a diagram illustrating a problem of the conventional technology.

In the fourth to seventh embodiments, as shown in FIG. 14, which illustrates a modification to the fourth embodiment, the inner peripheral surface portion 410 of the insertion hole 41 may be connected directly to the movable core opposed surfaces 363, 1363 without forming the movable core inclined surface 1362. In the sixth and seventh embodiments, the movable core inclined surface 362 in the shape of a curved surface of the second embodiment may be adopted. Moreover, instead of the formation of the movable core opposed surface 1363 in the shape of an easily-formable tapered surface, the movable core opposed surface 1363 may be formed in the shape of a curved surface. A diameter of this curved surface is reduced further in the valve opening direction Z1, and the diameter reduction ratio changes in the axial direction.

In the first to seventh embodiments, the injector 10 includes the second spring 46 that urges the movable core 36 toward the fixed core 35. However, the present invention may be effectively applied, even to an injector that does not have the second spring 46. In the first to seventh embodiments, the fixed core 35 is fixed in the cylindrical housing, which is composed of the cylindrical member 11, the inlet member 12, the nozzle holder 13, and the nozzle body 24, and the movable core 36 is accommodated between the nozzle hole 25 and the fixed core 35 inside the housing. However, the structure of the housing is not limited to those constituted of the above four members, and those made up of three members or less, or five members or more, for example, may be used for the structure of the housing.

The fixing mode in which the fixed core 35 is fixed to the inside of the housing, is not limited to the mode that is described in the first embodiment. For example, the fixed core 35 may be integrated with the inlet member 12, which serves as a part of the housing, or with the magnetic portion 16 of the cylindrical member 11. In the first to seventh embodiments, the injector 10 is applied to the direct injection type gasoline engine. However, the injector 10 is not limited to the direct injection type gasoline engine, and the injector 10 may be applied to a port-injection gasoline engine or a Diesel engine, for example.

The invention is summarized as follows. An injector includes a cylindrical housing 11, 12, 13, or 24, a fixed core 35, a cylindrical movable core 36, a valve member 14, and a resilient member 39. The housing 11, 12, 13, or 24 includes a nozzle hole 25 on one end side of the housing 11, 12, 13, or 24 in an axial direction of the housing 11, 12, 13, or 24. Fuel is injected through the nozzle hole 25. The fixed core 35 is fixed in the housing 11, 12, 13, or 24. The movable core 36 is disposed in the housing 11, 12, 13, or 24 between the fixed core 35 and the nozzle hole 25 in the axial direction to reciprocate in the housing 11, 12, 13, or 24 in the axial direction. An inner peripheral surface 44 of the housing 11, 12, 13, or 24 guides an outer peripheral surface 43 of the movable core 36 in the axial direction. The inner peripheral surface 44 of the housing 11, 12, 13, or 24 and the outer peripheral surface 43 of the movable core 36 define an outer radial clearance 72 therebetween. When fuel is injected, the movable core 36 is magnetically attracted to the fixed core 35 to be contactable with the fixed core 35 along a whole circumference of the movable core 36. The movable core 36 includes an insertion hole 41 which passes through a radially central part of the movable core 36 in the axial direction. The valve member 14 is disposed in the housing 11, 12, 13, or 24 to reciprocate in the axial direction, so that the valve member 14 opens and closes the nozzle hole 25 to inject fuel and stop injecting fuel through the nozzle hole 25. The valve member 14 includes a shaft-shaped portion 26 and a stopper portion 27. The shaft-shaped portion 26 extends in the axial direction and inserted in the insertion hole 41. An outer peripheral surface 42 of the shaft-shaped portion 26 and an inner peripheral surface 410 of the insertion hole 41 define an inner radial clearance 70 therebetween. The stopper portion 27 projects from the shaft-shaped portion 26 on a fixed core 35-side of the movable core 36 in a flanged manner radially outward of the shaft-shaped portion 26 to be contactable with the movable core 36, and includes a stopper inclined surface 271, 272, or 1272 around an axis 260 of the shaft-shaped portion 26. The stopper inclined surface 271, 272, or 1272 is inclined radially inward of the shaft-shaped portion 26 in the axial direction toward the nozzle hole 25 so that the stopper inclined surface 271, 272, or 1272 is contactable with the movable core 36 at a contact portion 82. An axial clearance 80 is formed between the stopper inclined surface 271, 272, or 1272 and the movable core 36 radially outward of the contact portion 82. The resilient member 39 is disposed in the housing 11, 12, 13, or 24 to press the valve member 14 toward the nozzle hole 25.

The outer peripheral surface 42 of the shaft-shaped portion 26 may include a recessed surface portion 420 around the axis 260 of the shaft-shaped portion 26. The recessed surface portion 420 is recessed radially inward of the shaft-shaped portion 26. The recessed surface portion 420 extends in the axial direction toward the nozzle hole 25 from a boundary 262 between the shaft-shaped portion 26 and the stopper inclined surface 271, 272, or 1272.

Accordingly, although the outer peripheral surface 42 is pressed on the inner peripheral surface 410 as a result of the inclination of the movable core 36 in conformity with the valve member 14, the inner clearance 70 is ensured between the recessed surface portion 420, which is recessed radially inward, and the surface 410. The clearance 70 exists between the recessed surface portion 420, which extends in the axial direction Z from the boundary 262 between the shaft shaped portion 26 and the stopper inclined surface 271, 272, or 1272 toward the nozzle hole 25, and the surface 410. Therefore, on the "pressed side of the shaft shaped portion 26," the contact portion 82 between the movable core 36 and the surface 271, 272, or 1272 is certainly displaced to the surface portion 420 side on which the clearance 70 is secured. Thus, the return of the movable core 36 back into the normal attitude is assured, so that the reliability of the injector 10 is enhanced as a fuel injection valve.

The resilient member 39 may be a first resilient member 39 that presses the stopper inclined surface 271, 272, or 1272 against the movable core 36. The injector may further include a second resilient member 46 that presses the movable core 36 on the stopper inclined surface 271, 272, or 1272.

In the structure, in which the stopper inclined surface 271, 272, or 1272 is pressed against the movable core 36 by the first resilient member 39, there is fear that the movable core 36 is inclined in conformity with the valve member 14. However, since the movable core 36 is pressed by the second resilient member 46 against the surface 271, 272, or 1272 which inclines further radially inward toward the nozzle hole 25 in the axial direction Z, the contact portion 82 between the movable core 36, to which the torque Fr in a direction to return into the normal attitude is applied, and the surface 271, 272, or 1272 is movable readily and quickly. Thus, the return of the movable core 36 back into the normal attitude is promptly realized, so that the reliability of the injector 10 is enhanced as a fuel injection valve.

At least the outer peripheral surface 43 of the movable core 36 at an end portion of the movable core 36 on the fixed core 35-side may include a sliding surface 43 that extends straight in the axial direction. The inner peripheral surface 44 of the housing 11, 12, 13, or 24 may include a guiding surface 44 that extends straight in the axial direction and slidably guides the sliding surface 43.

The sliding surface 43, which extends straight in the axial direction Z, is formed at least on the outer peripheral surface of the end portion of the movable core 36 on the opposite side of the nozzle hole 25. When the movable core 36 having such a sliding surface 43 is rotated by the torque Fr in the direction to return into the normal attitude, the sliding surface 43 of the movable core 36, which is pressed on the guiding surface 44, is guided by the guiding surface 44, which is an inner peripheral surface of the housing 11. Because similar to the sliding surface 43, the guiding surface 44 also extends straight in the axial direction Z, the movable core 36, to which the torque Fr is applied, rotates until the sliding surface 43 conforms with the guiding surface 44, i.e., until the movable core 36 is positioned in the normal attitude, in which axial directions of these surfaces coincide. Thus, the return of the movable core 36 back into the normal attitude is assured, so that the reliability of the injector 10 is enhanced as a fuel injection valve.

The movable core 36 may further include a movable core opposed surface 363 around an axis 412 of the insertion hole 41. The movable core opposed surface 363 expands flatly in a direction generally perpendicular to the axis 412 of the insertion hole 41 and is opposed to the stopper inclined surface 271, 272, or 1272 in the axial direction. The axial clearance 80 is formed between the stopper inclined surface 271, 272, or 1272 and the movable core opposed surface 363.

In consequence, between the stopper inclined surface 271, 272, or 1272, which inclines further radially inward toward the nozzle hole 25, and the movable core opposed surface 363, which spreads horizontally in the radial direction of the insertion hole 41 and which is opposed to the surface 271, 272, or 1272, the axial clearance 80 is reliably defined along the whole circumference. Hence, on the side on which the shaft shaped portion 26 is pressed against the inner peripheral surface 410 as well as on which the outer peripheral surface 43 is pressed on the housing 11, the rotation of the movable core 36, to which the torque Fr is applied in the direction to return into the normal attitude, to decrease the clearance 80, is not prevented by the surface 271, 272, or 1272. Thus, the return of the movable core 36 back into the normal attitude is assured, so that the reliability of the injector 10 is enhanced as a fuel injection valve.

The movable core 36 may further include a movable core opposed surface 1363 around an axis 412 of the insertion hole 41. The movable core opposed surface 1363 is inclined radially inward of the movable core 36 in the axial direction which is opposite from the nozzle hole 25, and opposed to the stopper inclined surface 271, 272, or 1272 in the axial direction. The axial clearance 80 is formed between the stopper inclined surface 271, 272, or 1272 and the movable core opposed surface 1363.

Accordingly, between the stopper inclined surface 271, 272, or 1272, which inclines further radially inward toward the nozzle hole 25, and the movable core opposed surface 1363, which inclines further radially inward to the opposite side of the nozzle hole 25 and which is opposed to the surface 271, 272, or 1272, the axial clearance 80 is reliably defined along the whole circumference.

The movable core 36 may further include a movable core inclined surface 361, 362, or 1362 around the axis 412 of the insertion hole 41. The movable core inclined surface 361, 362, or 1362 is connected between the inner peripheral surface 410 of the insertion hole 41 and the movable core opposed surface 363 or 1363 in a radial direction of the movable core 36 and inclined radially outward of the movable core 36 in the axial direction which is opposite from the nozzle hole 25.

The inner clearance 70 is ensured between the movable core 36 and the outer peripheral surface 42 of the shaft shaped portion 26 radially inward of the movable core inclined surface 361, 362, or 1362, which is connected radially between the inner peripheral surface 410 and the movable core opposed surface 363 or 1363 of the movable core 36, and which inclines further radially outward to the opposite side of the nozzle hole 25. Because of this, although the outer peripheral surface 42 is pressed on the inner peripheral surface 410 as a result of the inclination of the movable core 36 in conformity with the valve member 14, on the "pressed side" of the valve member 14 and the movable core 36, the contact portion 82 between the movable core 36 and the stopper inclined surface 271, 272, or 1272 is surely movable toward a radially inward space of the movable core 36 in which the clearance 70 is secured. Thus, the return of the movable core 36 back into the normal attitude is assured, so that the reliability of the injector 10 is enhanced as a fuel injection valve.

The movable core inclined surface 362 may be formed in a shape of a curved surface. A diameter of the curved surface reduces in the axial direction toward the nozzle hole 25. A diameter reduction ratio, in which the diameter of the curved surface reduces, becomes smaller in the axial direction toward the nozzle hole 25.

The movable core inclined surface 362 having the shape of such a curved surface can be in contact with the stopper inclined surface 271, 272, or 1272 which inclines further radially inward toward the nozzle hole 25. As a consequence, the movability of the contact portion 82 between the surface 362 and the surface 271, 272, or 1272 when the movable core 36 rotates through the application thereto of the torque Fr in the direction to return the movable core 36 into the normal attitude is improved. Thus, the return of the movable core 36 back into the normal attitude is assured, so that the reliability of the injector 10 is enhanced as a fuel injection valve.

The movable core inclined surface 361 or 1362 may be formed in a shape of a tapered surface. A diameter of the tapered surface reduces in the axial direction toward the nozzle hole 25. A diameter reduction ratio, in which the diameter of the tapered surface reduces, is constant in the axial direction.

Despite an easily-formable simple shape of the movable core inclined surface 361 or 1362 having the shape of such a tapered surface, the inner clearance 70 between the surface 361 or 1362, and the outer peripheral surface 42 of the shaft shaped portion 26 is secured. Thus, the return of the movable core 36 back into the normal attitude is achieved using its comparatively inexpensive structure, and the reliability of the injector 10 is enhanced as a fuel injection valve.

Also, an injector includes a cylindrical housing 11, 12, 13, or 24, a fixed core 35, a coil 34, a cylindrical movable core 36, a valve member 14, and a resilient member 39. The housing 11, 12, 13, or 24 includes a nozzle hole 25 on one end side of the housing 11, 12, 13, or 24 in an axial direction of the housing 11, 12, 13, or 24. Fuel is injected through the nozzle hole 25. The fixed core 35 is fixed in the housing 11, 12, 13, or 24 at a predetermined position thereof. The coil 34 is energized. The movable core 36 is disposed in the housing 11, 12, 13, or 24 between the fixed core 35 and the nozzle hole 25 in the axial direction, and magnetically attracted to the fixed core 35 upon energization of the coil 34. The valve member 14 is disposed in the housing 11, 12, 13, or 24 to reciprocate in the axial direction, so that the valve member 14 opens and closes the nozzle hole 25 to inject fuel and stop injecting fuel through the nozzle hole 25. The valve member 14 includes a shaft-shaped portion 26 and a stopper portion 27. The shaft-shaped portion 26 is inserted in a central hole 41 of the movable core 36 which passes through a radially central part of the movable core 36 in the axial direction, and extends toward the nozzle hole 25. The stopper portion 27 is formed at a fixed core 35-side end portion of the shaft-shaped portion 26, and projects in a flanged manner radially outward of the shaft-shaped portion 26 so as to be contactable with a surface 45 of the movable core 36 on the fixed core 35-side. The stopper portion 27 includes a stopper inclined surface 271, 272, or 1272 on a movable core 36-side of the stopper portion 27 around an axis 260 of the shaft-shaped portion 26. The stopper inclined surface 271, 272, or 1272 is inclined relative to the axis 260. The movable core 36 includes a 361, 362, or 1362 on a stopper portion 27-side of the movable core 36. The movable core inclined surface 361, 362, or 1362 is inclined along the stopper inclined surface 271, 272, or 1272. At least one of the stopper inclined surface 271, 272, or 1272 and the movable core inclined surface 361, 362, or 1362 is a curved surface that projects toward the other one of the stopper inclined surface 271, 272, or 1272 and the movable core inclined surface 361, 362, or 1362. The resilient member 39 is disposed in the housing 11, 12, 13, or 24 to press the valve member 14 toward the nozzle hole 25.

As a result, even in the case of inclination of the valve member 14 with reference to the movable core 36, the contact region between the movable core 36 and the stopper portion 27 is relatively shifted, so that the contact between the stopper inclined surface 271, 272, or 1272 and the movable core inclined surface 361, 362, or 1362 along their whole circumferences is maintained. Therefore, the generation of wear due to the one-sided contact as in the conventional technology is prevented. Thus, the highly-reliable injector 10 is provided.

The curved surface may be a spherical surface.

Hence, the contact state between the stopper inclined surface 271, 272, or 1272 and the movable core inclined surface 361, 362, or 1362 is maintained to be constantly the same, so that the displacement of the valve member 14 with reference to its axial direction is limited.

The stopper inclined surface 272 may be inclined to the movable core 36 as well as to the axis 260.

Accordingly, each inclined surface of the valve member 14 and the movable core 36 is readily produced.

The stopper inclined surface 271 or 1272 may be a curved surface that projects toward the movable core inclined surface 361 or 1362. The movable core inclined surface 361 or 1362 may be a flat inclined surface.

Accordingly, the production of a curved surface on the inclined surface 271 or 1272 of the valve member 14 is facilitated.

Additional advantages and modifications will readily occur to those skilled in the art. The invention in its broader terms is therefore not limited to the specific details, representative apparatus, and illustrative examples shown and described.

What is claimed is:

1. An injector comprising:

a cylindrical housing that includes a nozzle hole on one end side of the housing in an axial direction of the housing, wherein fuel is injected through the nozzle hole;

a fixed core that is fixed in the housing;

a cylindrical movable core that is disposed in the housing between the fixed core and the nozzle hole in the axial direction to reciprocate in the housing in the axial direction, wherein:

an inner peripheral surface of the housing guides an outer peripheral surface of the movable core in the axial direction;

the inner peripheral surface of the housing and the outer peripheral surface of the movable core define an outer radial clearance therebetween;

when fuel is injected, the movable core is magnetically attracted to the fixed core to be contactable with the fixed core along a whole circumference of the movable core; and the movable core includes an insertion hole which passes through a radially central part of the movable core in the axial direction;

a valve member that is disposed in the housing to reciprocate in the axial direction, so that the valve member opens and closes the nozzle hole to inject fuel and stop injecting fuel through the nozzle hole, wherein the valve member includes:

a shaft-shaped portion extending in the axial direction and inserted in the insertion hole, an outer peripheral surface of the shaft-shaped portion and an inner peripheral surface of the insertion hole defining an inner radial clearance therebetween, the inner radial clearance and the outer radial clearance being sized so as to permit an inclination of the valve member relative to the housing and the movable core; and a stopper portion which projects from the shaft-shaped portion on a fixed core-side of the movable core in a flanged manner radially outward of the shaft-shaped portion to be contactable with the movable core, and which includes a stopper inclined surface around an axis of the shaft-shaped portion, the stopper inclined surface being inclined radially inward of the shaft-shaped portion in the axial direction toward the nozzle hole such that an outer diameter of at least a part of the stopper portion decreases along the axis of the shaft-shaped portion in the axial direction toward the nozzle hole, so that the stopper inclined surface is contactable with the movable core at a contact portion, an axial clearance being formed between the stopper inclined surface and the movable core radially outward of the contact portion; and a resilient member that is disposed in the housing to press the stopper portion of the valve member toward the nozzle hole, wherein the resilient member is a first resilient member that presses the stopper inclined surface a against the movable core.

2. The injector according to claim 1, wherein:

the outer peripheral surface of the shaft-shaped portion includes a recessed surface portion around the axis of the shaft-shaped portion;

the recessed surface portion is recessed radially inward of the shaft-shaped portion; and the recessed surface portion extends in the axial direction toward the nozzle hole from a boundary between the shaft-shaped portion and the stopper inclined surface.

3. The injector according to claim 1, further comprising a second resilient member that presses the movable core on the stopper inclined surface.

4. The injector according to claim 1, wherein:

at least the outer peripheral surface of the movable core at an end portion of the movable core on the fixed core-side includes a sliding surface that extends straight in the axial direction; and the inner peripheral surface of the housing includes a guiding surface that extends straight in the axial direction and slidably guides the sliding surface.

5. The injector according to claim 1, wherein:

the movable core further includes a movable core opposed surface around an axis of the insertion hole;

the movable core opposed surface expands flatly in a direction generally perpendicular to the axis of the insertion hole and is opposed to the stopper inclined surface in the axial direction; and the axial clearance is formed between the stopper inclined surface and the movable core opposed surface.

6. The injector according to claim 5, wherein:

the movable core further includes a movable core inclined surface around the axis of the insertion hole; and the movable core inclined surface is connected between the inner peripheral surface of the insertion hole and the movable core opposed surface in a radial direction of the movable core and inclined radially outward of the movable core in the axial direction which is opposite from the nozzle hole.

7. The injector according to claim 6, wherein:

the movable core inclined surface is formed in a shape of a curved surface;

a diameter of the curved surface reduces in the axial direction toward the nozzle hole; and a diameter reduction ratio, in which the diameter of the curved surface reduces, becomes smaller in the axial direction toward the nozzle hole.

8. The injector according to claim 6, wherein:

the movable core inclined surface is formed in a shape of a tapered surface;

a diameter of the tapered surface reduces in the axial direction toward the nozzle hole; and a diameter reduction ratio, in which the diameter of the tapered surface reduces, is constant in the axial direction.

9. The injector according to claim 1, wherein:

the movable core further includes a movable core opposed surface around an axis of the insertion hole;

the movable core opposed surface is inclined radially inward of the movable core in the axial direction which is opposite from the nozzle hole, and opposed to the stopper inclined surface in the axial direction; and the axial clearance is formed between the stopper inclined surface and the movable core opposed surface.

10. The injector according to claim 9, wherein:

the movable core further includes a movable core inclined surface around the axis of the insertion hole; and the movable core inclined surface is connected between the inner peripheral surface of the insertion hole and the movable core opposed surface in a radial direction of the movable core and inclined radially outward of the movable core in the axial direction which is opposite from the nozzle hole.

11. The injector according to claim 10, wherein:

the movable core inclined surface is formed in a shape of a curved surface;

a diameter of the curved surface reduces in the axial direction toward the nozzle hole; and a diameter reduction ratio, in which the diameter of the curved surface reduces, becomes smaller in the axial direction toward the nozzle hole.

12. The injector according to claim 10, wherein:

the movable core inclined surface is formed in a shape of a tapered surface;

a diameter of the tapered surface reduces in the axial direction toward the nozzle hole; and a diameter reduction ratio, in which the diameter of the tapered surface reduces, is constant in the axial direction.

13. The injector according to claim 1, wherein:

the stopper inclined surface is formed in a shape of a tapered surface;

a diameter of the tapered surface reduces in the axial direction toward the nozzle hole; and a diameter reduction ratio, in which the diameter of the tapered surface reduces, is constant in the axial direction.

14. The injector according to claim 1, wherein:

the stopper inclined surface is formed in a shape of a curved surface;

a diameter of the curved surface reduces in the axial direction toward the nozzle hole; and a diameter reduction ratio, in which the diameter of the curved surface reduces, becomes larger in the axial direction toward the nozzle hole.

15. An injector comprising:

a cylindrical housing that includes a nozzle hole on one end side of the housing in an axial direction of the housing, wherein fuel is injected through the nozzle hole;

a fixed core that is fixed in the housing at a predetermined position thereof;

a coil that is energized;

a cylindrical movable core that is disposed in the housing between the fixed core and the nozzle hole in the axial direction and that is magnetically attracted to the fixed core upon energization of the coil;

a valve member that is disposed in the housing to reciprocate in the axial direction, so that the valve member opens and closes the nozzle hole to inject fuel and stop injecting fuel through the nozzle hole, wherein:

the valve member includes:

a shaft-shaped portion that is inserted in a central hole of the movable core which passes through a radially central part of the movable core in the axial direction, and that extends toward the nozzle hole; and a stopper portion that is formed at a fixed core-side end portion of the shaft-shaped portion and that projects in a flanged manner radially outward of the shaft-shaped portion so as to be contactable with a surface of the movable core on the fixed core-side;

the stopper portion includes a stopper inclined surface on a movable core-side of the stopper portion around an axis of the shaft-shaped portion, the stopper inclined surface being inclined relative to the axis, the stopper inclined surface being inclined such that an outer diameter of at least a part of the stopper portion decreases along the axis of the shaft-shaped portion in the axial direction toward the nozzle hole;

the movable core includes a movable core inclined surface on a stopper portion-side of the movable core, the movable core inclined surface being inclined along the stopper inclined surface; and at least one of the stopper inclined surface and the movable core inclined surface is a curved surface that projects toward the other one of the stopper inclined surface and the movable core inclined surface; and a resilient member that is disposed in the housing to press the stopper portion of the valve member toward the nozzle hole wherein the resilient member presses the stopper inclined surface against the movable core.

16. The injector according to claim 15, wherein the curved surface is a spherical surface.

17. The injector according to claim 15, wherein the stopper inclined surface is inclined to the movable core as well as to the axis.

18. The injector according to claim 17, wherein:

the stopper inclined surface is a curved surface that projects toward the movable core inclined surface; and the movable core inclined surface is a flat inclined surface.

19. An injector comprising:

a cylindrical housing that includes a nozzle hole on one end side of the housing in an axial direction of the housing, wherein fuel is injected through the nozzle hole;

a fixed core that is fixed in the housing;

a cylindrical movable core that is disposed in the housing between the fixed core and the nozzle hole in the axial direction to reciprocate in the housing in the axial direction, wherein:

an inner peripheral surface of the housing guides an outer peripheral surface of the movable core in the axial direction;

the inner peripheral surface of the housing and the outer peripheral surface of the movable core define an outer radial clearance therebetween;

when fuel is injected, the movable core is magnetically attracted to the fixed core to be contactable with the fixed core along a whole circumference of the movable core; and the movable core includes an insertion hole which passes through a radially central part of the movable core in the axial direction;

a valve member that is disposed in the housing to reciprocate in the axial direction, so that the valve member opens and closes the nozzle hole to inject fuel and stop injecting fuel through the nozzle hole, wherein the valve member includes:

a shaft-shaped portion extending in the axial direction and inserted in the insertion hole, an outer peripheral surface of the shaft-shaped portion and an inner peripheral surface of the insertion hole defining an inner radial clearance therebetween; and a stopper portion which projects from the shaft-shaped portion on a fixed core-side of the movable core in a flanged manner radially outward of the shaft-shaped portion to be contactable with the movable core, and which includes a stopper inclined surface around an axis of the shaft-shaped portion, the stopper inclined surface being inclined radially inward of the shaft-shaped portion in the axial direction toward the nozzle hole so that the stopper inclined surface is contactable with the movable core at a contact portion, an axial clearance being formed between the stopper inclined surface and the movable core radially outward of the contact portion; and a resilient member that is disposed in the housing to press the valve member toward the nozzle hole, wherein:

the outer peripheral surface of the shaft-shaped portion includes a recessed surface portion around the axis of the shaft-shaped portion;

the recessed surface portion is recessed radially inward of the shaft-shaped portion; and the recessed surface portion extends in the axial direction toward the nozzle hole from a boundary between the shaft-shaped portion and the stopper inclined surface.

* * * * *